US007563235B2

(12) United States Patent
van der Meer

(10) Patent No.: US 7,563,235 B2
(45) Date of Patent: Jul. 21, 2009

(54) BODY VIBRATION APPARATUS

(75) Inventor: Guus van der Meer, Badhoevedorp (NL)

(73) Assignee: Power Plate North America, Inc., Irvine, CA (US)

( * ) Notice: Subject to any disclaimer, the term of this patent is extended or adjusted under 35 U.S.C. 154(b) by 106 days.

(21) Appl. No.: 10/946,265

(22) Filed: Sep. 20, 2004

(65) Prior Publication Data

US 2005/0131319 A1 Jun. 16, 2005

Related U.S. Application Data

(60) Provisional application No. 60/504,011, filed on Sep. 19, 2003.

(51) Int. Cl.
*A61H 1/00* (2006.01)

(52) U.S. Cl. ..... 601/70; 601/49

(58) Field of Classification Search ..... 601/23, 601/24, 26–32, 46, 49, 60, 65, 67, 69, 70, 601/78, 82, 86, 90, 104; 482/92, 110, 148; 310/81

See application file for complete search history.

(56) References Cited

U.S. PATENT DOCUMENTS

| | | | | |
|---|---|---|---|---|
| 1,970,233 | A | 8/1934 | Hertzberg | |
| 2,235,183 | A * | 3/1941 | Wettlaufer | 601/65 |
| 2,271,382 | A * | 1/1942 | Worthington | 601/61 |
| 2,311,274 | A | 2/1943 | Whitney | |
| 2,498,977 | A * | 2/1950 | Bertholin | 601/62 |
| 2,893,380 | A | 7/1959 | Walker et al. | |
| 2,902,993 | A | 9/1959 | Wagner | |
| 3,052,235 | A | 9/1962 | Stewart | |
| 3,203,415 | A | 8/1965 | Moore | |
| 3,550,587 | A | 12/1970 | Kawada | |
| 3,617,056 | A | 11/1971 | Herbold | |
| 3,765,407 | A | 10/1973 | Prince | |
| 4,570,616 | A * | 2/1986 | Kunz et al. | 601/70 |

(Continued)

FOREIGN PATENT DOCUMENTS

| | | |
|---|---|---|
| DE | 19532254 | 10/1996 |

(Continued)

OTHER PUBLICATIONS

Declaration of Jerry Beckman executed Apr. 26, 2005.

(Continued)

*Primary Examiner*—Justine R Yu
*Assistant Examiner*—Kristen C Matter
(74) *Attorney, Agent, or Firm*—Levenfeld Pearlstein, LLC

(57) ABSTRACT

A body vibration apparatus includes an at least partially rigid platform, a first motor coupled to the platform such that movement of the first motor imparts force to the platform. The first motor has a first shaft that rotates a first eccentric weight in a first direction, phase and plane. A second motor is coupled to the platform such that movement of the second motor imparts force to the platform. The second motor has a second shaft parallel to the first shaft that rotates in a second direction, which, in one embodiment, is opposite the first direction. A second eccentric weight is coupled to the second shaft in the first plane. The second eccentric weight rotates with the second shaft at the first phase.

21 Claims, 26 Drawing Sheets

U.S. PATENT DOCUMENTS

| | | | | |
|---|---|---|---|---|
| 4,709,362 | A | 11/1987 | Cole | |
| 4,989,587 | A | 2/1991 | Farley | |
| 4,989,857 | A | 2/1991 | Kuo | |
| 5,131,525 | A * | 7/1992 | Musschoot | 198/770 |
| 5,188,096 | A | 2/1993 | Yoo | |
| 5,298,002 | A | 3/1994 | Lin | |
| 5,429,562 | A | 7/1995 | Milner | |
| 5,512,025 | A | 4/1996 | Dalebout et al. | |
| 5,716,331 | A | 2/1998 | Chang | |
| 5,730,687 | A | 3/1998 | Ledany | |
| 5,971,901 | A | 10/1999 | Shaw | |
| 6,375,630 | B1 | 4/2002 | Cutler et al. | |
| 6,440,092 | B1 * | 8/2002 | Leventhal et al. | 601/148 |

FOREIGN PATENT DOCUMENTS

| | | |
|---|---|---|
| DE | 19634396 | 3/1998 |
| DE | 19634397 | 3/1998 |
| JP | 8057080 A2 | 3/1996 |

OTHER PUBLICATIONS

Power Plate International, "O metodo mais eficaz contra a celulite," 2002, Entire Document (translation from Portuguese included).

Power Plate International, "Power Plate Manual," 2002, Entire Document.

Power Plate International, "A revolutionary approach to training," 2002, Entire Document.

Uniphy Elektromedizin, "FitVibe Specifications," 2003, Entire Document.

Uniphy Elektromedizin, "Whole Body Vibration Short Training Sessions," 2003, Enitre Document.

Uniphy Elektromedizin, "Whole Body Vibration Work effortlessly on a better figure," 2003, Entire Document.

Uniphy Elektromedizin, "Whole Body Vibration [glier productdesign], " 2003, Entire Document.

Uniphy Elektromedizin, "fitvibe: Total Body Effect!," 2003, Entire Document.

* cited by examiner

4
START
STOP
REPEAT

BODY VIBRATION APPARATUS

CROSS-REFERENCE TO RELATED APPLICATION

This application claims priority of U.S. provisional application No. 60/504,011 filed Sep. 19, 2003, the disclosure of which is incorporated fully herein by reference.

BACKGROUND

Human body vibration has been shown to improve health, appearance, fitness, circulation and hormone secretion in humans of all ages. To withstand mechanical energy transferred to the body by vibration, muscles vigorously expand and contract. After repeated sessions of vibration, the body can adjust to the movement, resulting in an increase in muscle performance. Studies have shown that fast, vertical sinusoidal motion can lead to better fitness results when the body undergoes rapid and repeated gravitational force changes and naturally resists these changes.

Conventional body vibration machines are typically made up of a single motor rotating an eccentric weight around a shaft. In these systems, the movement force of the eccentric weight is imparted to the motor as a whole, and can function as a discrete area massager if placed below a flexible surface, such as a cloth, and held against a muscle to be massaged. This massaging action, however, generally imparts very little force on the body, and the body's natural resistance to the vibration felt by it is minimal. Such a massager is shown in U.S. Pat. No. 5,188,096.

Other conventional systems mount a single motor to a fairly rigid platform on which a person may sit or stand. The motor imparts the circular force onto the rigid platform, causing the person to resist the rotating forces of the eccentric weight. A second eccentric weight can also be added to an opposite side of the motor's shaft, imparting alternating diagonal forces on the platform. An example of such a machine is shown in U.S. Pat. No. 2,902,993. However, because much of the force from the eccentric weights in these machines is transferred to the platform, and the person, in a horizontal direction, additional strain can be imparted to the joints of the person, and less vertical force is imparted to the platform for increasing the gravitational forces experienced by the user.

SUMMARY OF THE INVENTION

The instant invention relates to simple and effective body vibration apparatus. In one embodiment, the body vibration apparatus includes an at least partially rigid platform, a first motor coupled to the platform such that movement of the first motor imparts force to the platform. The first motor has a first shaft that rotates a first eccentric weight in a first direction, phase and plane. A second motor is coupled to the platform such that movement of the second motor imparts force to the platform. The second motor has a second shaft parallel to the first shaft that rotates in a second direction, which, in one embodiment, is opposite the first direction. A second eccentric weight is coupled to the second shaft in the first plane. The second eccentric weight rotates with the second shaft at the first phase.

In one embodiment of the invention, two motors rotating eccentric weights on their horizontal, parallel axes are fixed to a vibrating platform. The vibrating platform is supported by a vibrational mounting assembly, which allows three dimensional vibration. The motors operate at the same frequency and phase, and transfer a sinusoidal vibration to a user positioned on the platform by rotating the eccentric weights in opposite directions. In one embodiment, the motors can be operated at 30 Hz, 35 Hz, 40 Hz and 50 Hz to achieve varying levels of vibration at 30, 45 and 60 second periods. The amplitude of vibration can be intensified by operating the motors with heavier, or less balanced eccentric weights. These settings can be input by a user into a main display/control panel.

The effects that have been observed by embodiment of this system are increases in muscle strength by 20 to 30% more than with conventional power training with an 85% reduced training time; increases in flexibility and mobility; secretion of important regenerative hormones, such as HGH, IGF-1 and testosterone that aid in explosive strength; increased levels of seratonin and neurotrophine; reduction in cortisol; improvement in blood circulation; strengthening of bone tissue; pain reduction; and muscle strengthening. It has also been shown that vibration training reduces the strain on joints, ligaments and tendons, and trains fast, white muscle fibers better than conventional power training.

These advantages are especially important for both athletes and older citizens. This system may also have similar positive effects on MS, ME, fibromyalgia, and arthritis patients.

In addition to the positive health effects, the vibration imparted by the instant invention may also improve cosmetic appearance, including improving lymph drainage and circulation, which can reduce cellulitis and fat.

BRIEF DESCRIPTION OF THE DRAWINGS

The detailed description of embodiments of the invention will be made in reference to the accompanying drawings, wherein like numerals represent corresponding elements.

DETAILED DESCRIPTION OF THE INVENTION

Figure 8:
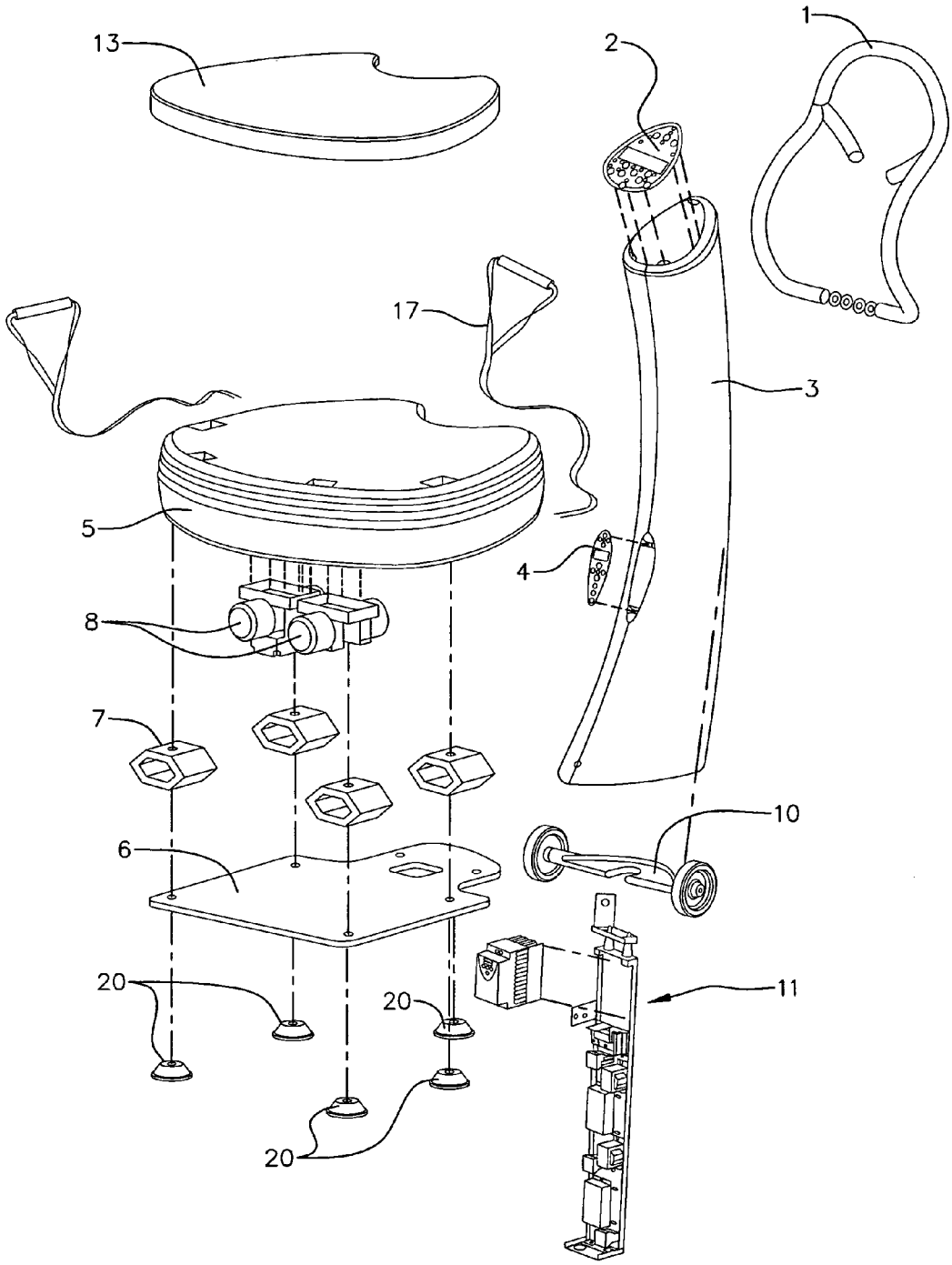
FIG. 8 is an exploded view of another embodiment of a vibrational fitness apparatus according to the invention.

FIGS. 1-7 show a main console 3 and a base 5 of one embodiment of the invention. A base 5 is adjacent to the main console 3 on a baseplate 6. As shown in more detail in FIG. 8, two motors 8 inside of the base 5 are mounted adjacent and spaced apart from each other beneath the top surface of the base 5. The motors 8 rotate eccentric weights (shown in FIGS. 16-21) in opposite directions around substantially parallel axes running from the back to the front of the base 5. Vibration mounts 7 support the motors 8 above the baseplate 6, while allowing vibration of the motors 8 in all three dimensions. When a user inputs a frequency of rotation, level of intensity, and duration of an exercise into a main 2 or secondary 4 display on the main console 3, the motors 8 are driven with that frequency, intensity, or duration to produce a vertical sinusoidal vibration and a somewhat erratic horizontal vibration, on the top surface of the base 5.

As shown in FIGS. 1-4 and 8, the main console 3 is substantially vertical and houses a main display 2, a bottom or secondary display 4, a power inlet and switch assembly 9 and an electronics console 11. The electronics console 11 can be mounted directly to the main console 3, as shown, or alternatively suspended from the main console 3 by suspension rubbers (not shown). Such suspension may isolate the electronics console 11 from excessive vibration.

In one embodiment, the main console 3 also houses a detachable transport assembly 10, which can be detached during operation and attached for transport. A set of handlebars 1 extend from the main console 3 and are preferably made of steel with foam rubber grips.

Figure 9:
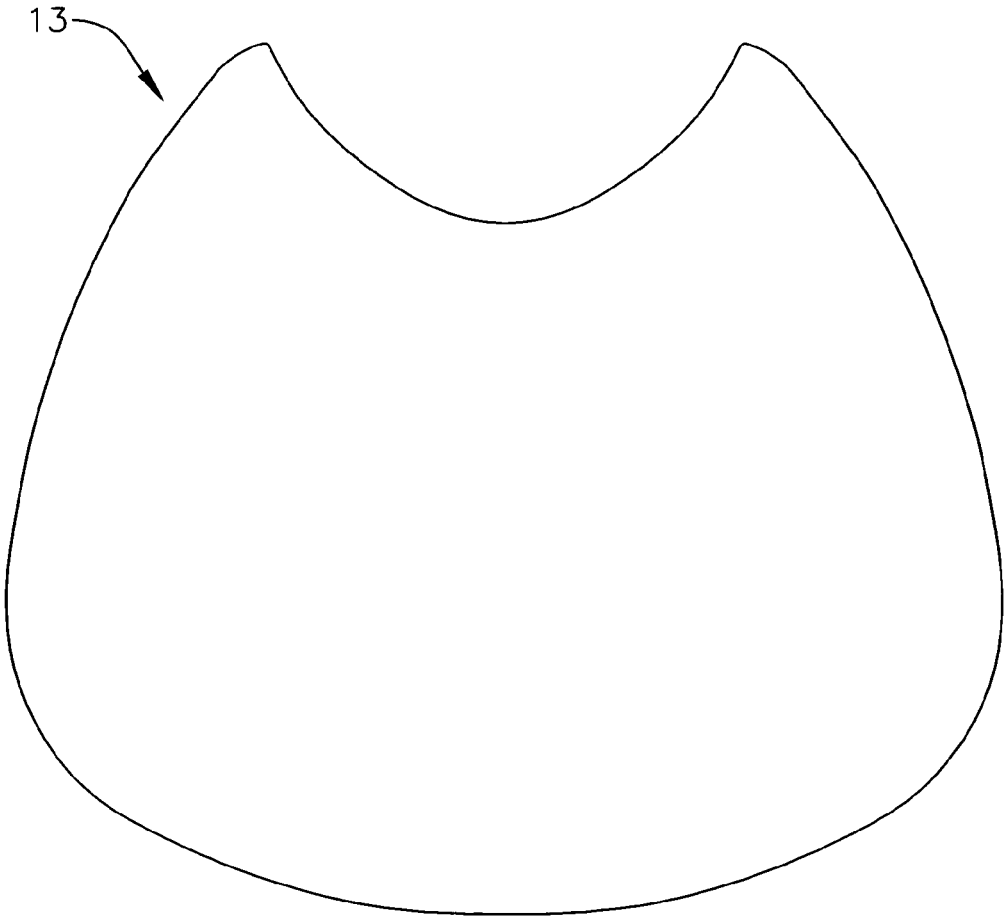
FIG. 9 is a plan view of an exercise mat of the embodiments shown in FIGS. 1 and 8.

The base housing 5 is preferably made of fiber reinforced plastic (FRP) along its upper and horizontal periphery and covered on its top surface by an anti-slip surface 13, as shown in FIG. 9. As shown in FIGS. 2, 3, 5, 8 and 12, the base housing 5 surrounds a vibration mounting assembly 15, a vibrating base assembly 19 and a motor assembly 8, 80. Flexible straps 17 with hand or foot grips can be fixed at each end of the base housing to allow vibration from the platform to be transferred to muscles pulling the straps 17.

Figure 10:
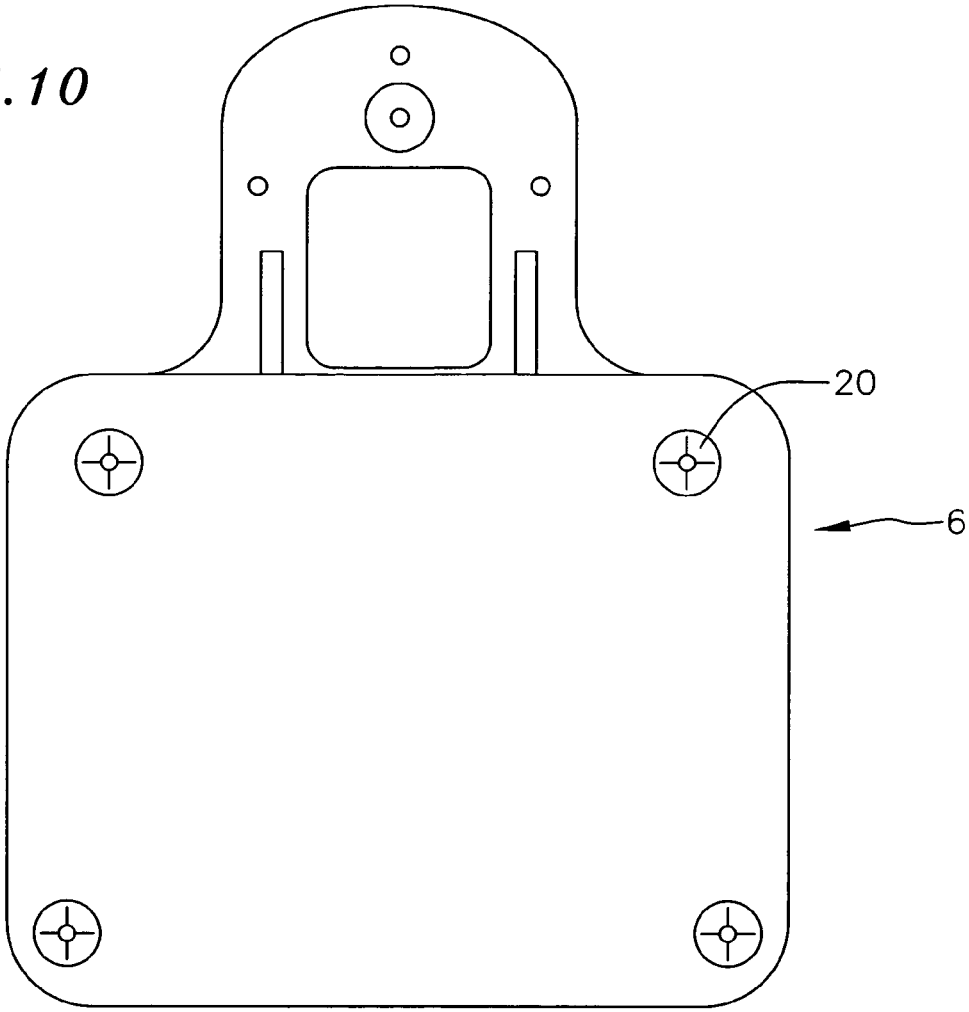
FIG. 10 is a plan view of a baseplate of the embodiments shown in FIGS. 1 and 8.
Figure 11:
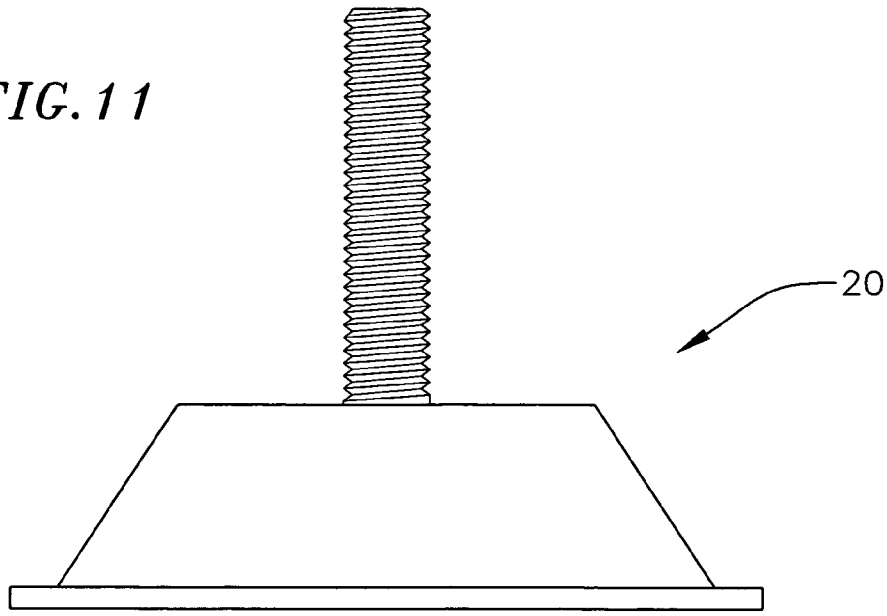
FIG. 11 is a front perspective view of a rubber foot of the embodiments shown in FIGS. 1 and 8.

The baseplate 6 is shown in more detail in FIG. 10. The baseplate is preferably 13 mm thick steel with sufficient size and shape to support both the vibrating base assembly 19 and the main console 3. Preferably, the base plate 6 has enough mass to ensure stability during use and the stiffness to withstand the forces induced by vibration of the system. The baseplate 6 also isolates the system from the floor surface on which it is supported in order to minimize the dissipation of vibrational forces into the floor. In one embodiment, five height-adjustable rubber feet 20 project downward from the baseplate 6 to stabilize it on the floor, as shown in FIG. 11.

A base housing 5 is molded from FRP in the shape shown in FIGS. 1-8. The vibrating base assembly 19 and vibration mounting assembly 15 within the base housing are shown in more detail in FIGS. 2 and 12-14. Mounted on the top surface of the baseplate are four vibration mounts 7 that support a motor mounting frame 15. Preferably, the vibration mounts 7 are formed of an elastomeric material that is capable of allowing three dimensional vibration of the motor mounting frame 15. In one embodiment, the vibration mounts 7 are shaped with hollow, hexagonal cross sections that are mounted with a horizontal shaft transverse to the axes of rotation of the motors. In this embodiment, forces in that direction are damped more from the deformation of the vibration mount material than are the vertical forces.

Figure 1:
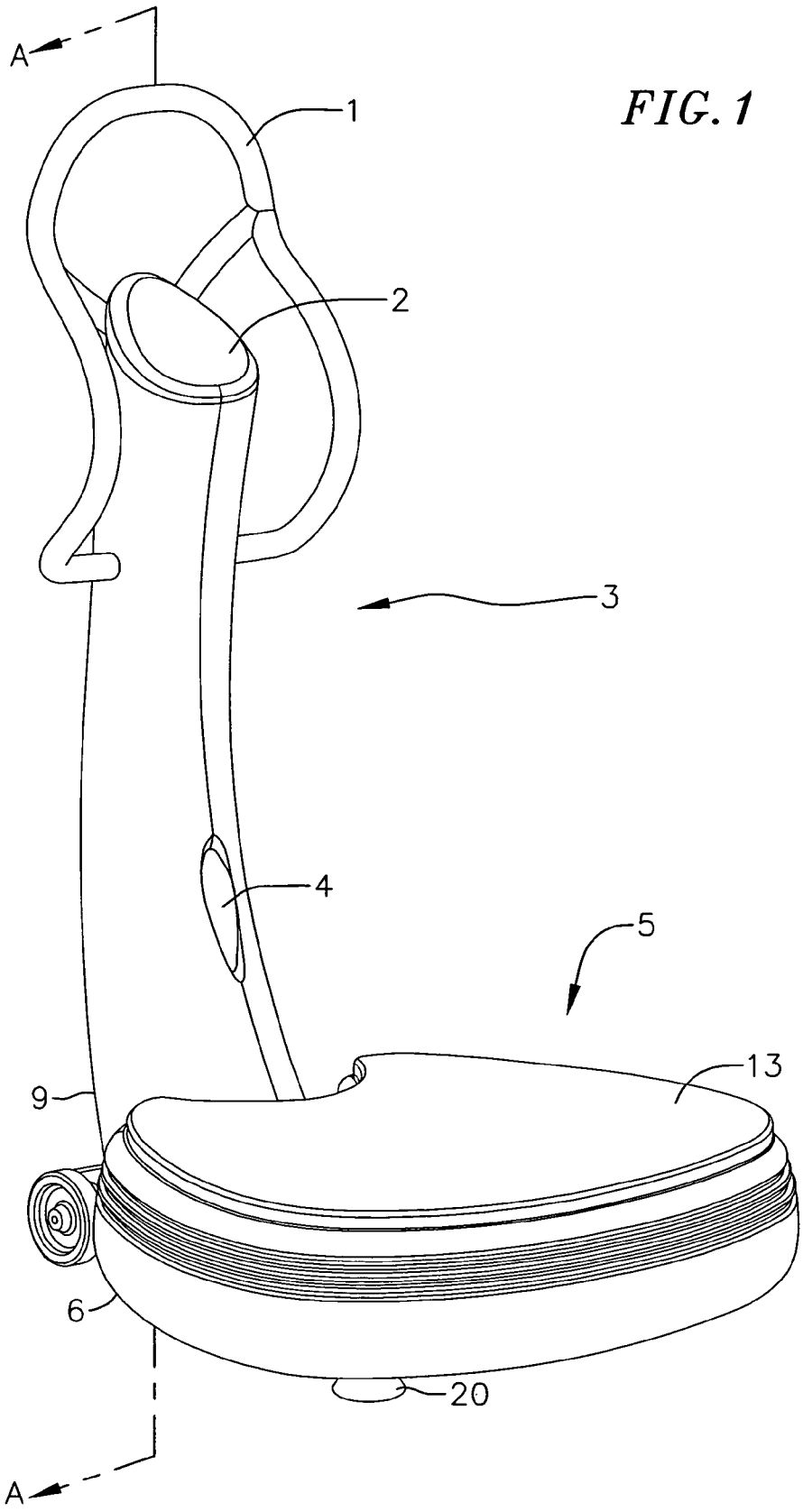
FIG. 1 is a front perspective view of one embodiment of a vibrational fitness apparatus according to the invention.
Figure 2:
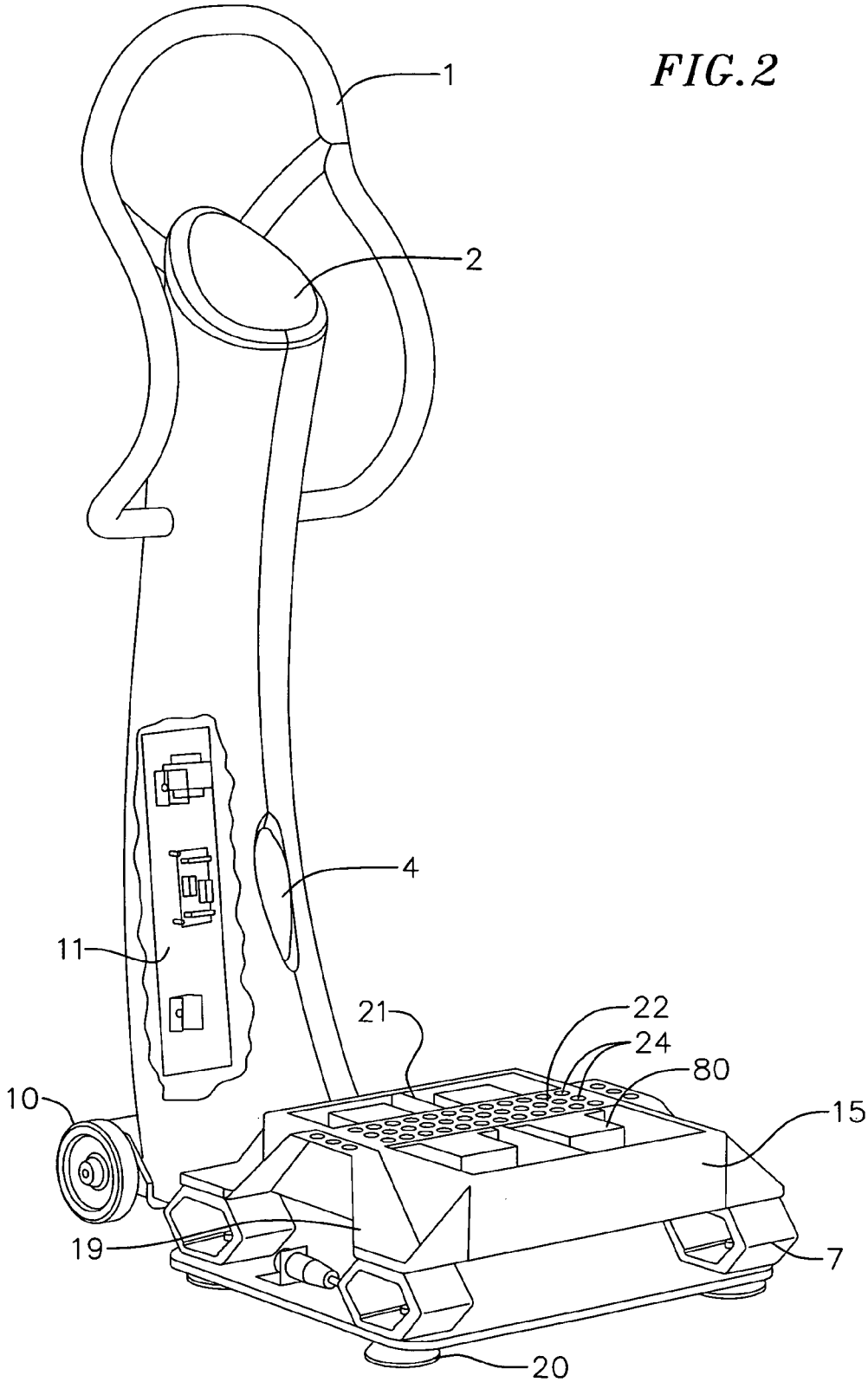
FIG. 2 is a front perspective view of the embodiment shown in FIG. 1 without a base housing and with a cutout in the main console to expose the electronics console.
Figure 3:
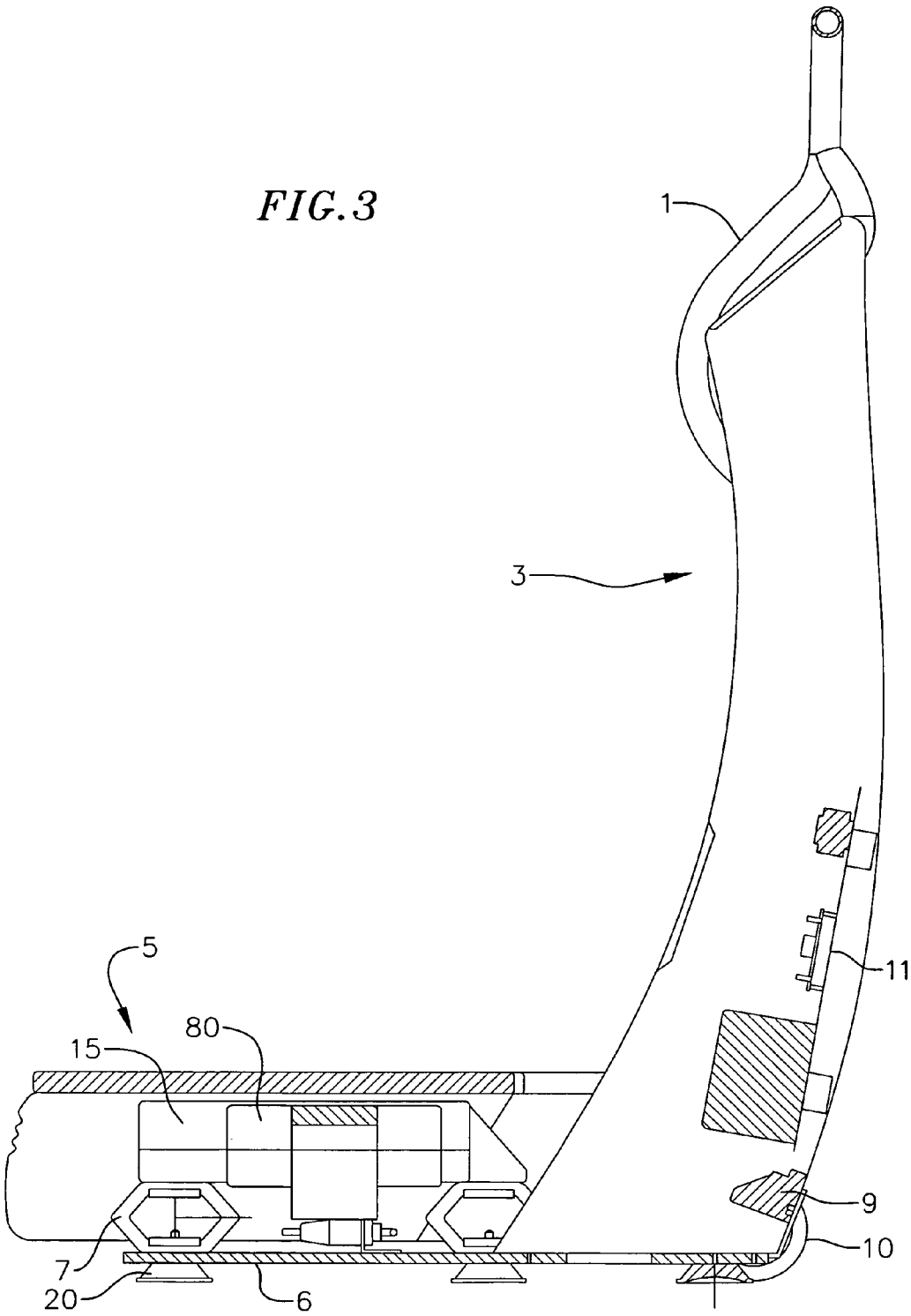
FIG. 3 is a vertical cross-sectional view of the embodiment shown in FIG. 1 taken along the direction A-A.
Figure 4:
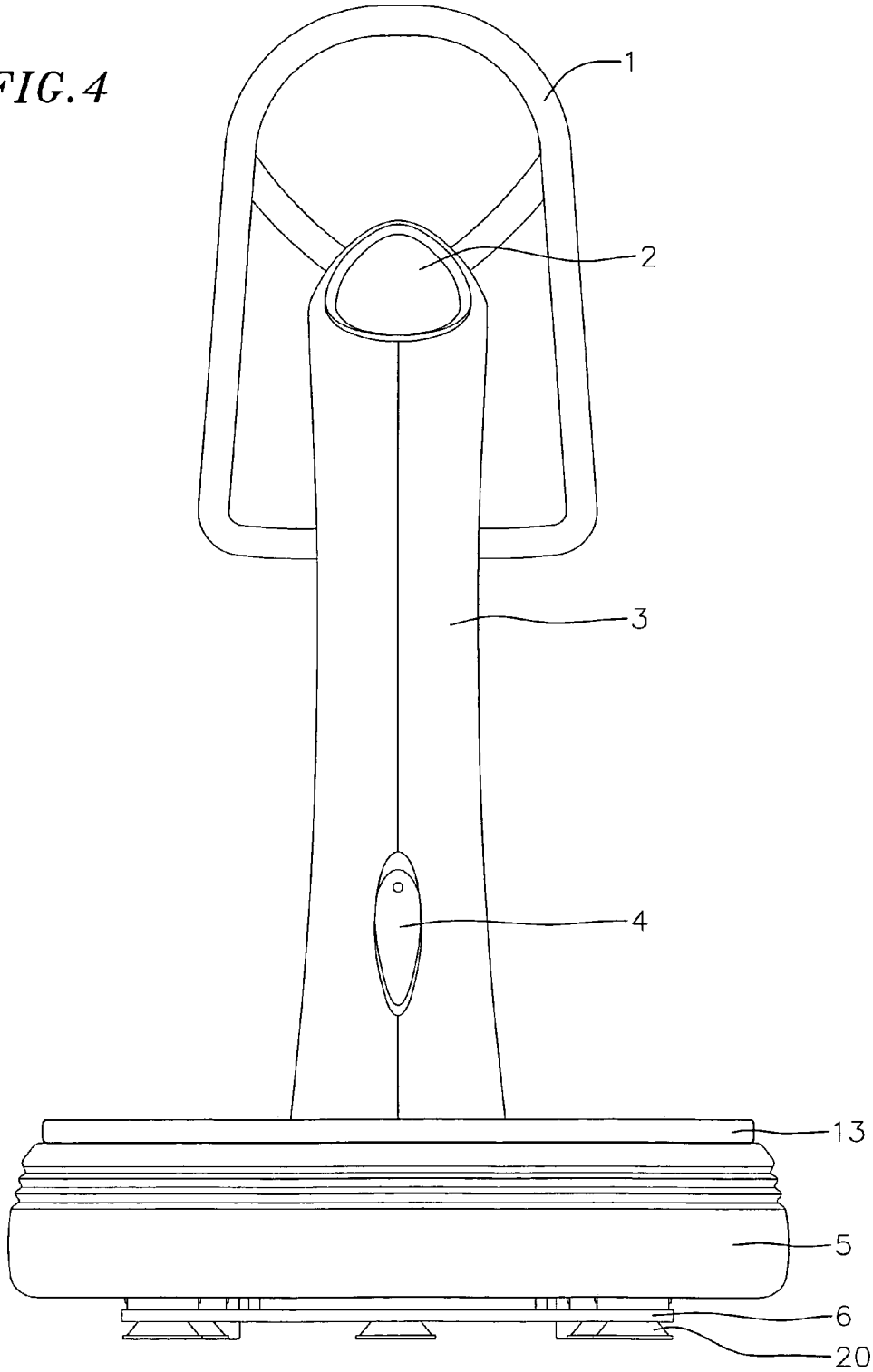
FIG. 4 is a front view of the embodiment shown in FIG. 1.
Figure 5:
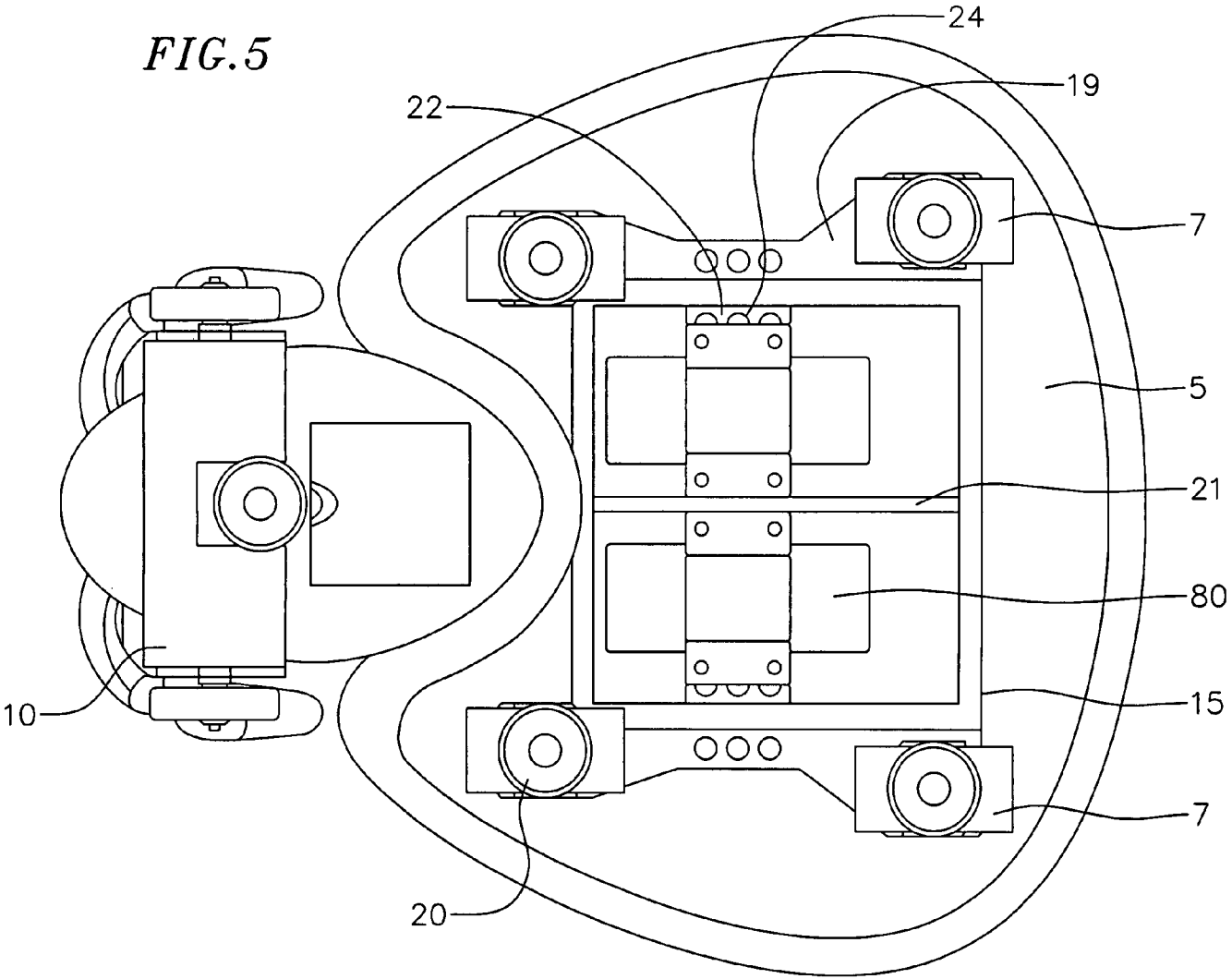
FIG. 5 is a bottom view of the embodiment shown in FIG. 1 without a baseplate.
Figure 6:
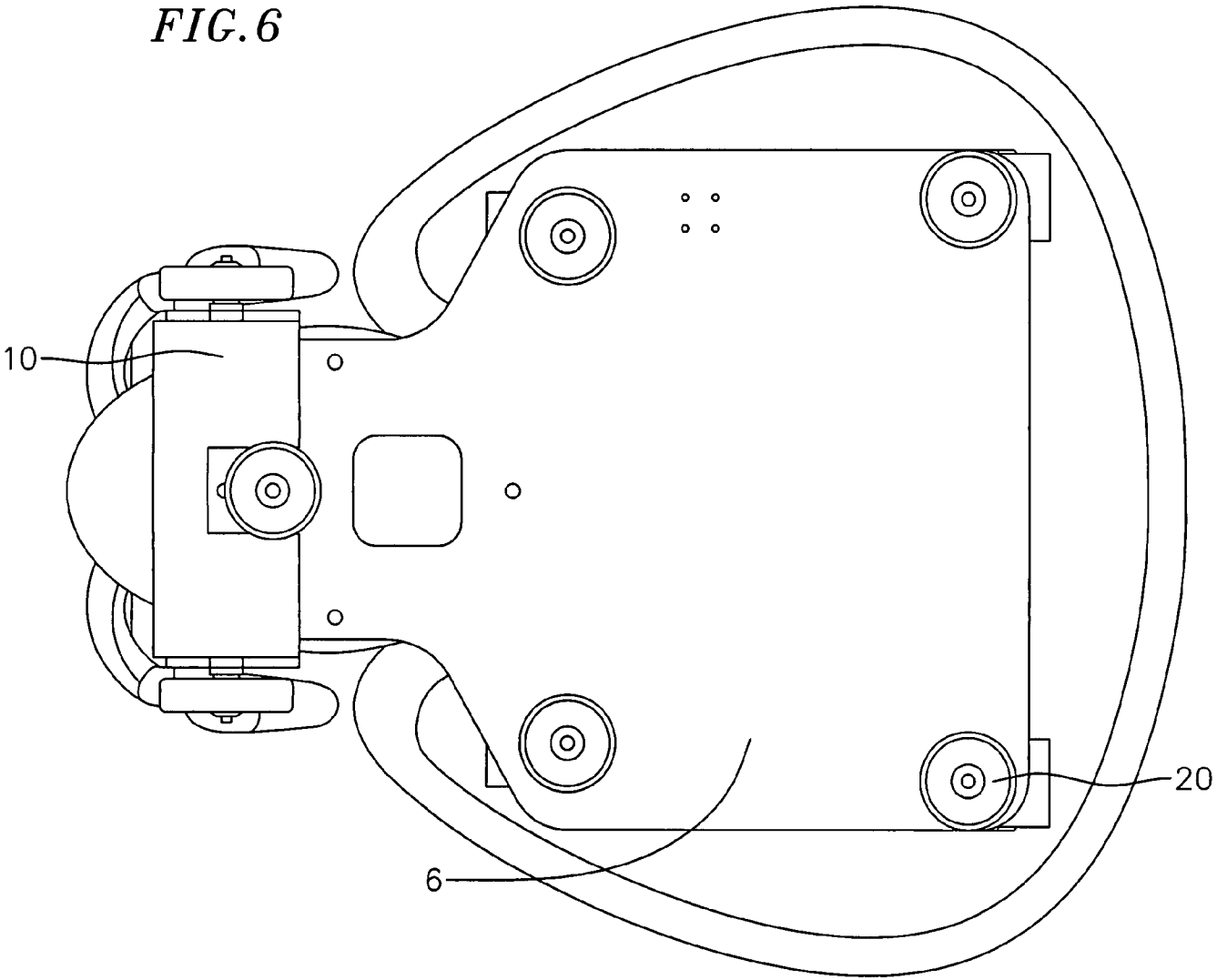
FIG. 6 is a bottom view of the embodiment shown in FIG. 1.
Figure 7:
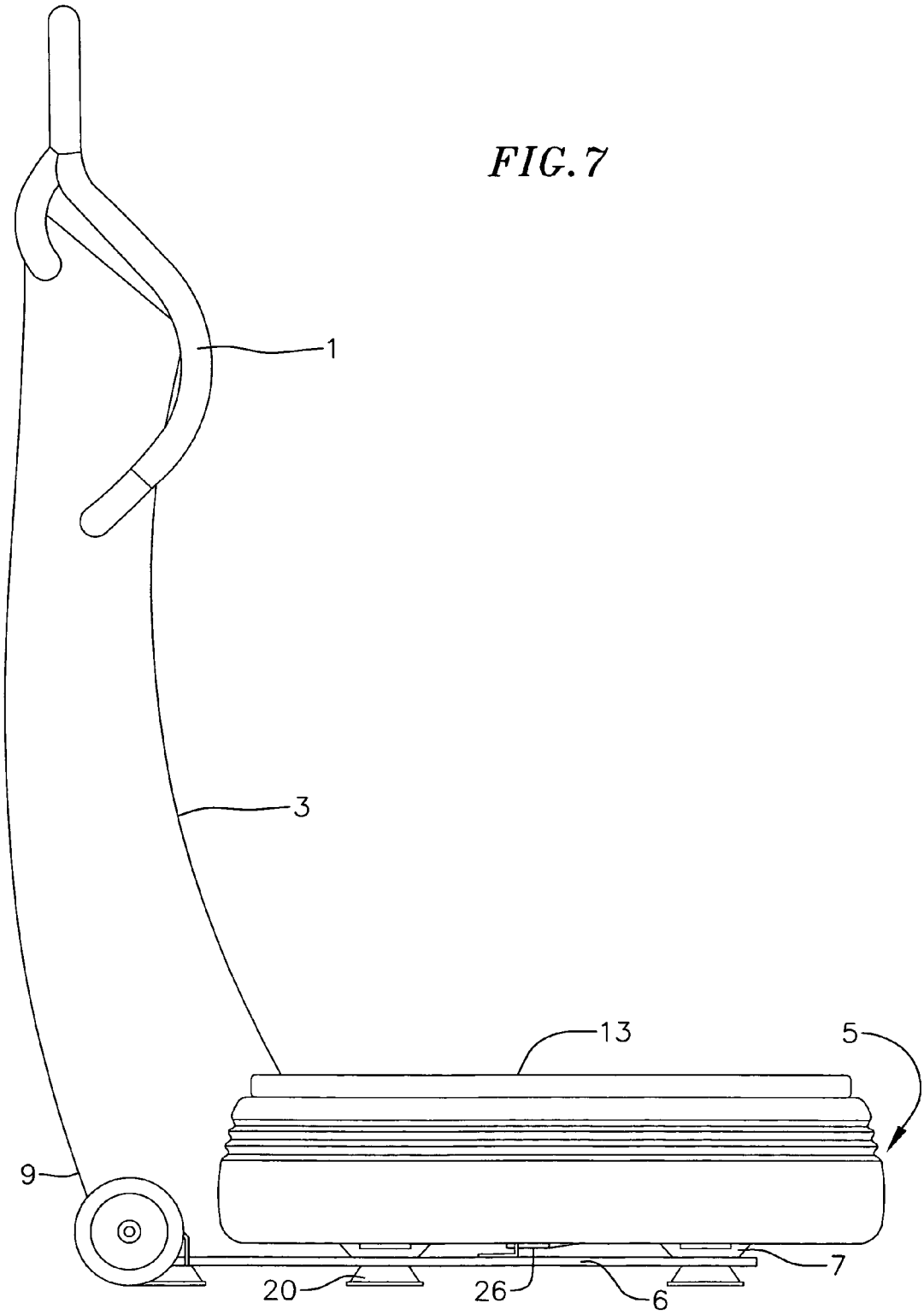
FIG. 7 is a side view of the embodiment shown in FIG. 1.
Figure 12A:
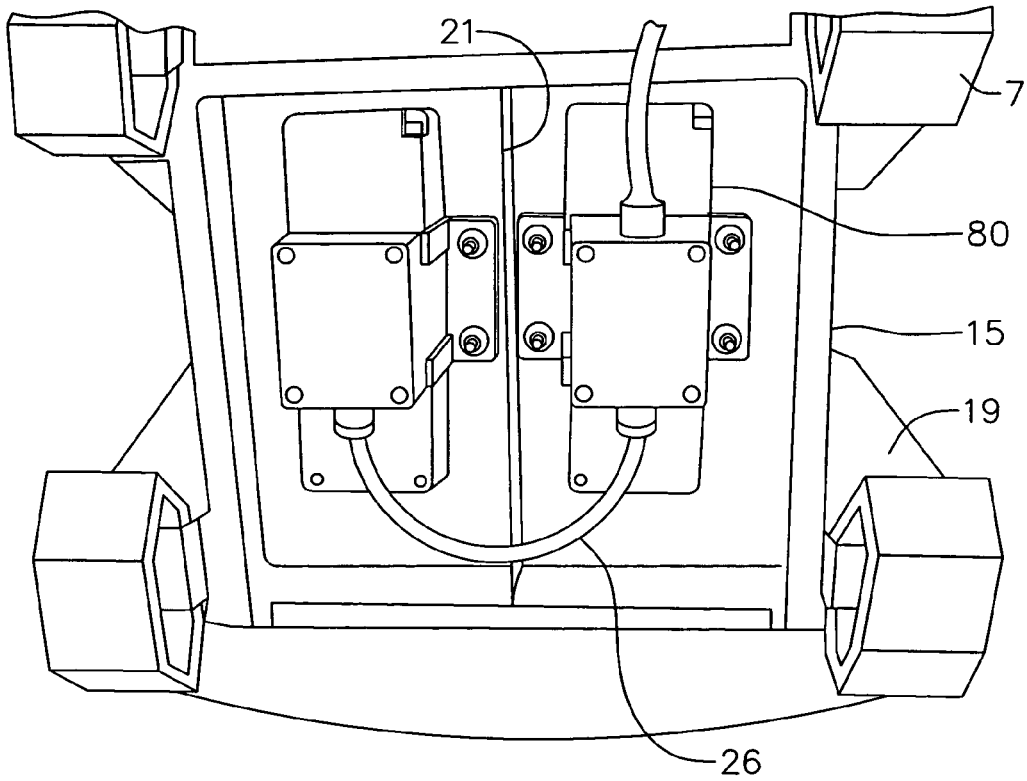
FIG. 12*a* is a bottom perspective view of the motor mounting frame, vibrational mounting assembly, and motor housing of the embodiment shown in FIGS. 1 and 8.

As shown in FIGS. 2, 5 and 12*a*, the motor mounting frame 15 includes a hollow, square, steel frame with mounting surfaces extending outward from the corners for mounting on the vibration mounts. A steel reinforcement 21 is fixed to two opposite sides of the square's inner surface. A strip of steel 22 with mounting holes 24 is fixed in a horizontal orientation to the other two opposite sides of the square's upper surface. The FRP base housing 5 is molded into this strip of steel 22 to integrate it into the base housing. Two motor housings 80 are mounted spaced apart with substantially horizontal and parallel axes on the underside of the FRP-covered strip of steel 5, 22. The motor housings 80 are mounted onto either side of the central axis of strip 22. In the embodiment shown, the housings 80 are mounted by bolts with anti-slip nuts. Vibration-withstanding power cables 26 supply power from a motor connector, located within the base 5 beneath the motor mounting frame 15.

Figure 12B:
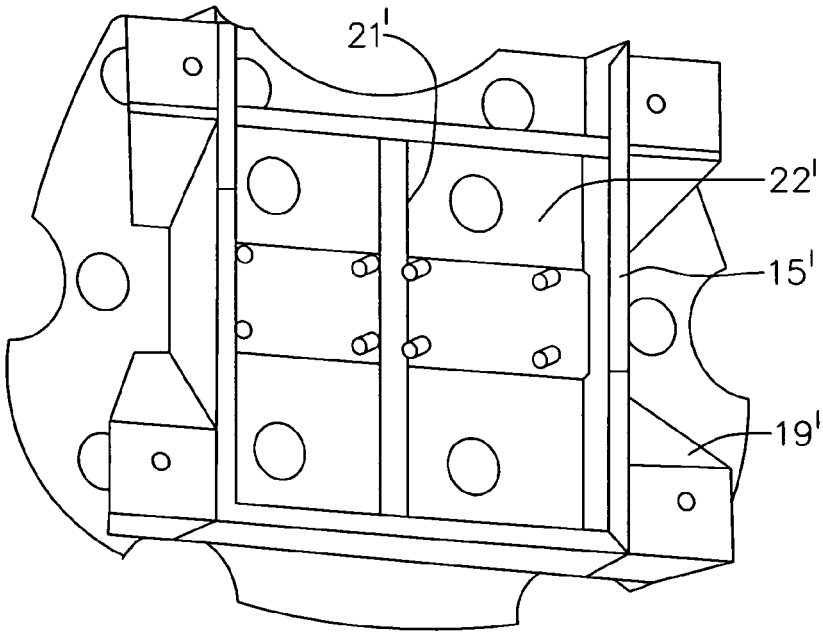
FIG. 12*b* is a bottom perspective view of an alternate embodiment of the motor mounting frame.
Figure 13:
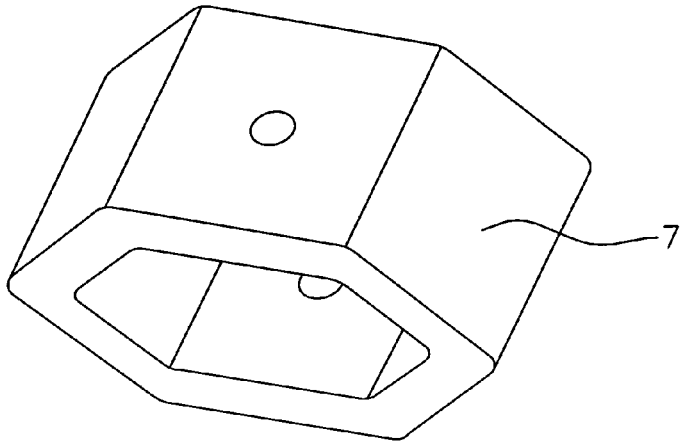
FIG. 13 is a perspective view of a vibration mount of the embodiment shown in FIG. 12.
Figure 14:
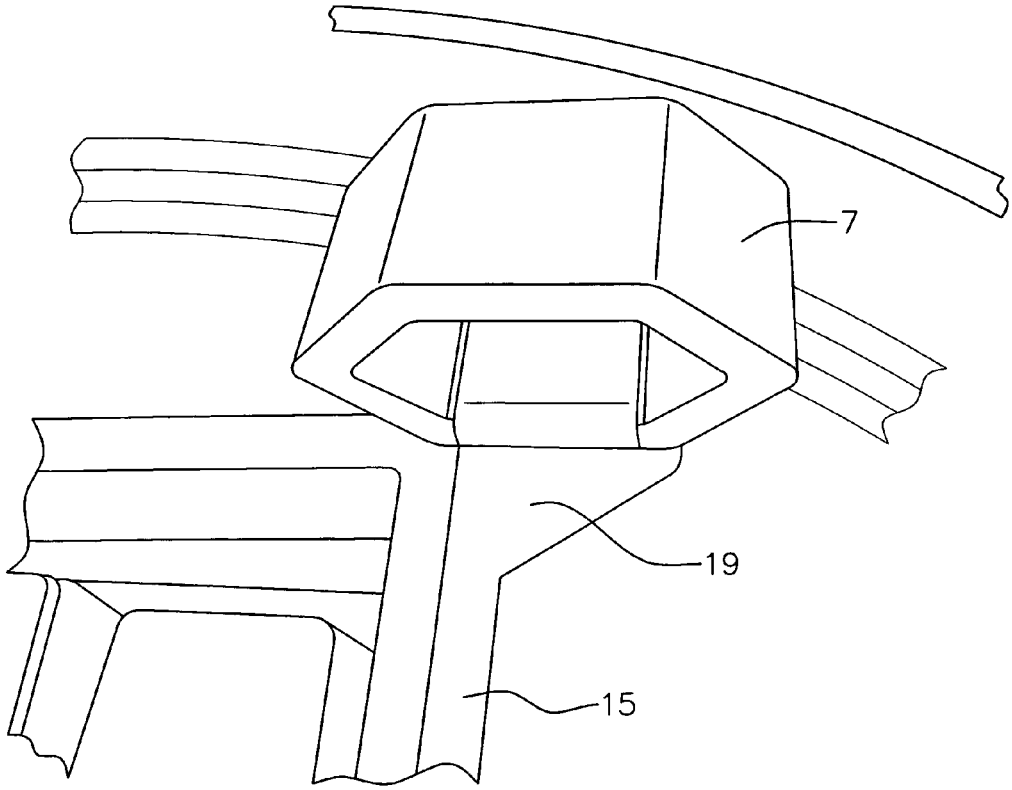
FIG. 14 is a bottom perspective view of a vibration mount of the embodiment shown in FIG. 12.
Figure 15:
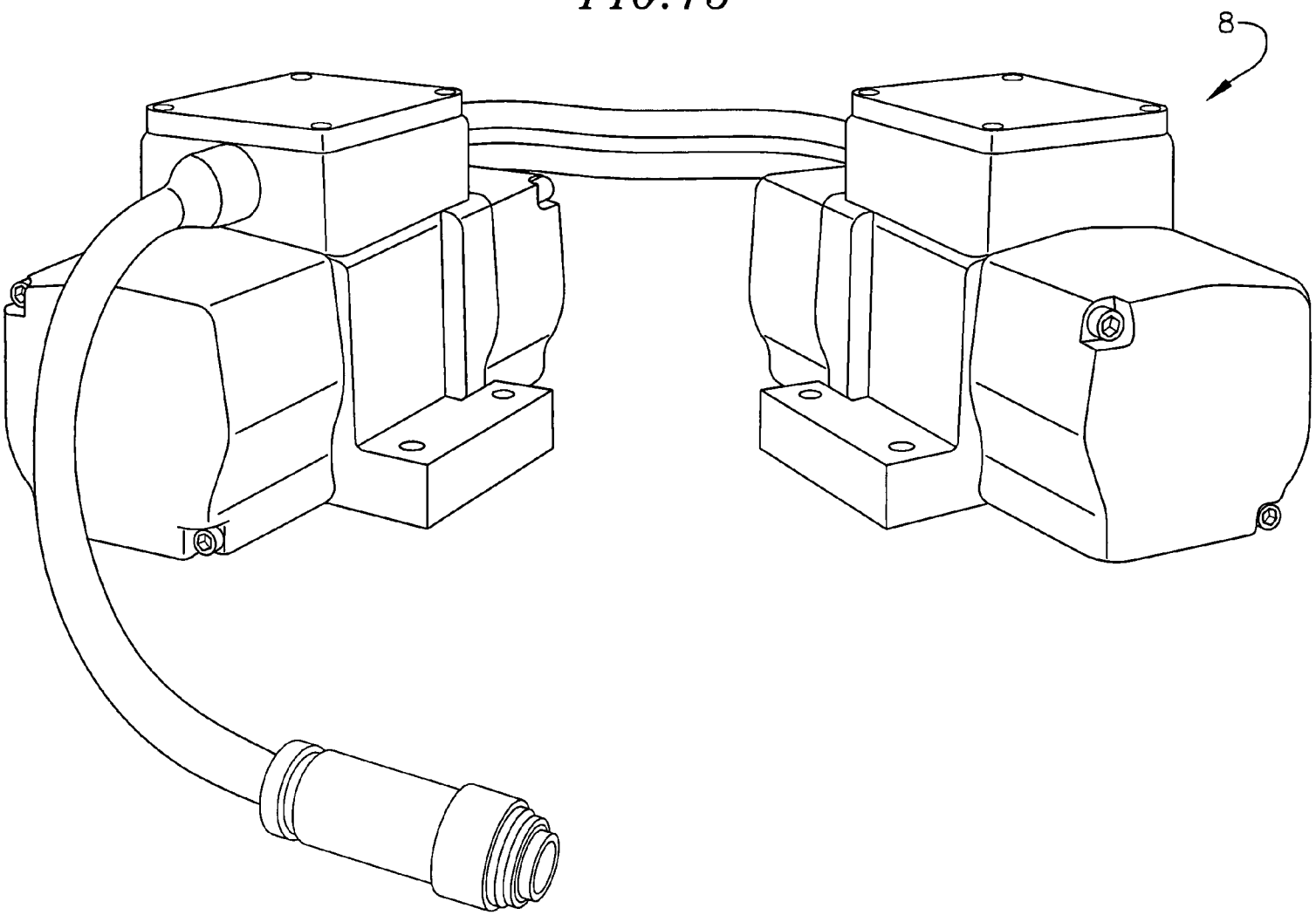
FIG. 15 is a perspective view of two motor assemblies of the embodiments shown in FIGS. 1 and 8.
Figure 16:
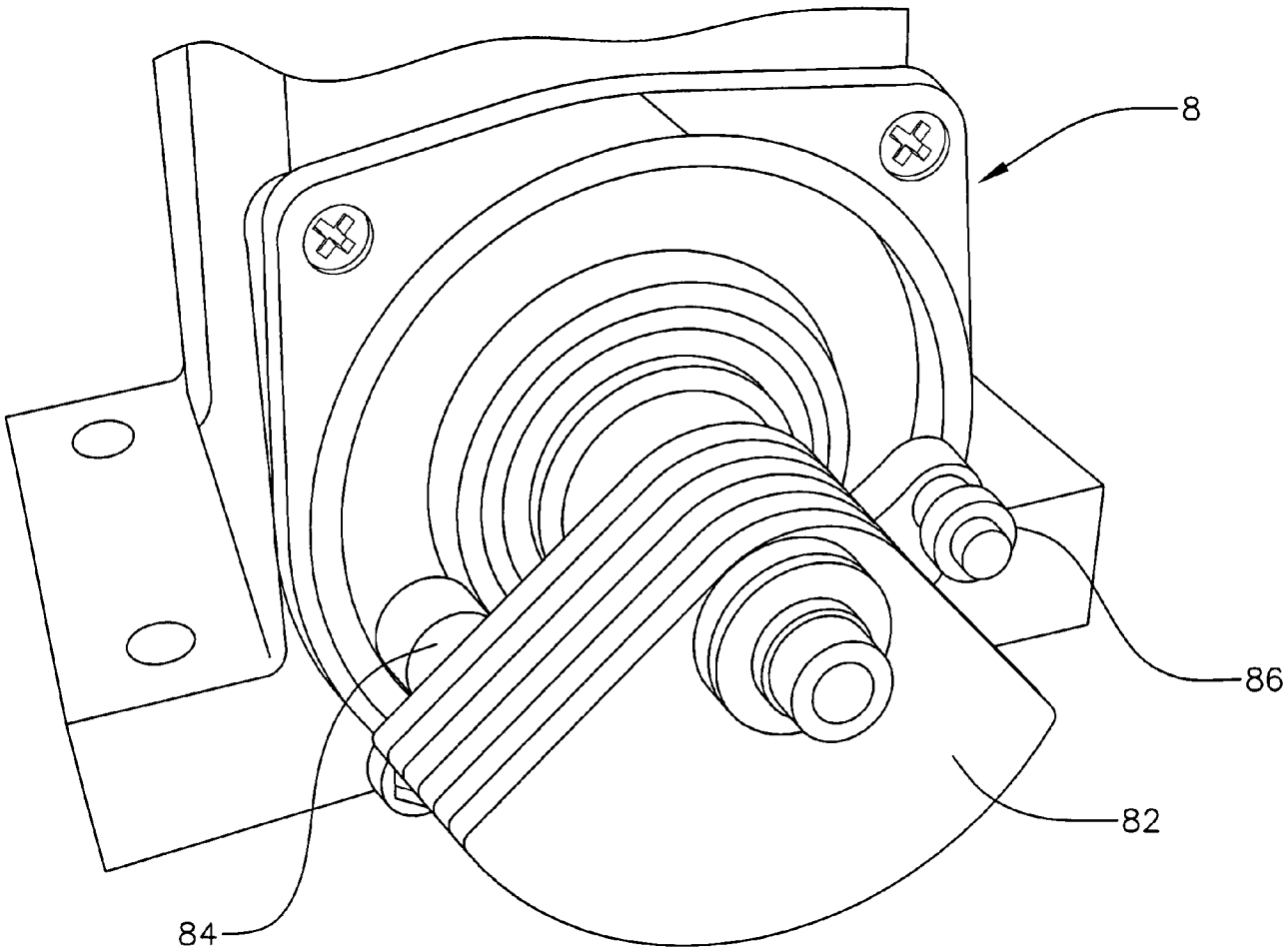
FIG. 16 is a perspective view of thin, eccentric weights installed on a motor shaft of the embodiments shown in FIGS. 1 and 8.
Figure 17:
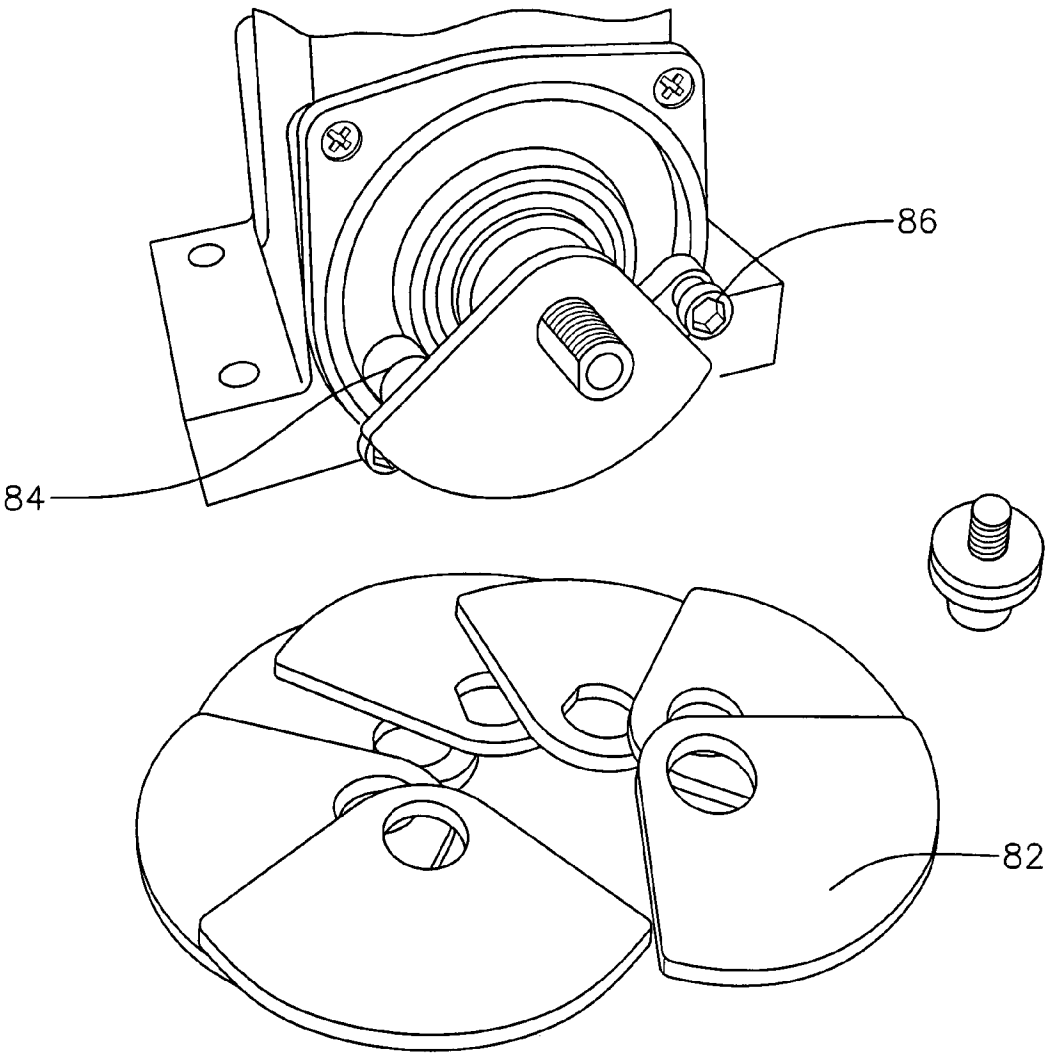
FIG. 17 is a perspective view of the thin, eccentric weights of FIG. 16 in a partially disassembled condition.
Figure 18:
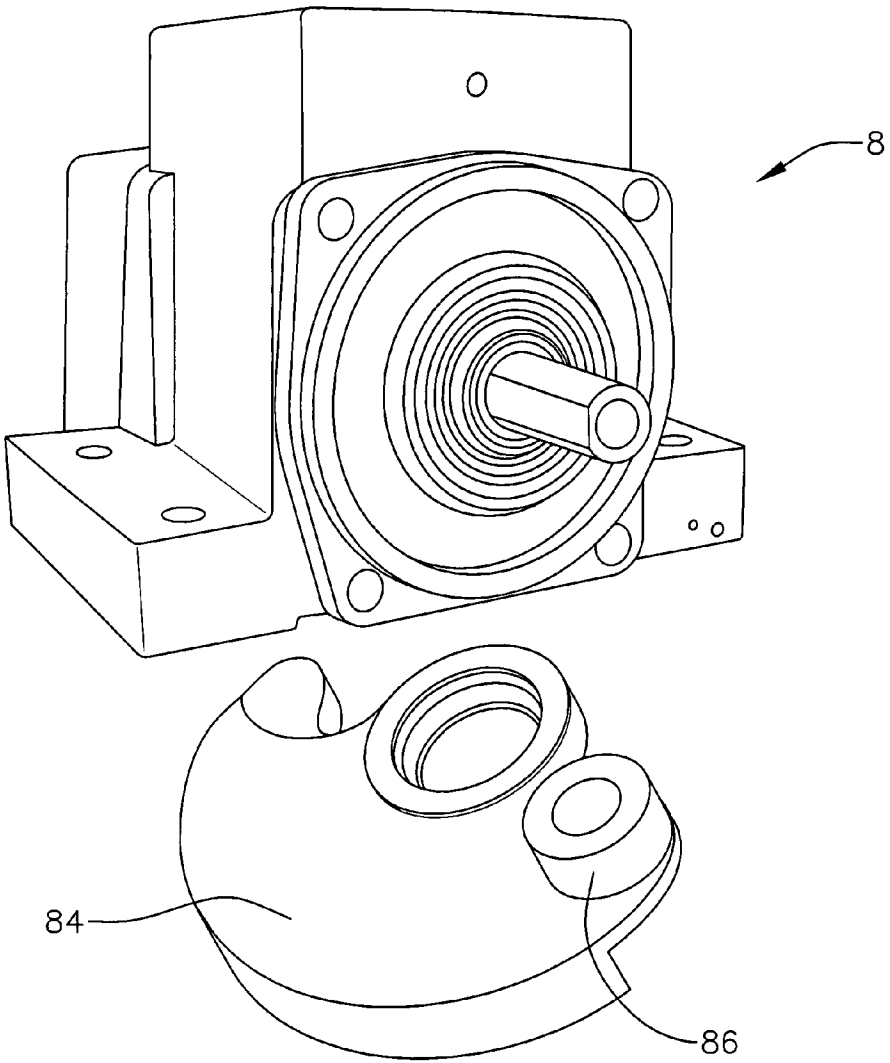
FIG. 18 is a perspective view of a main counterweight and the thin, eccentric weights of FIG. 16.
Figure 19:
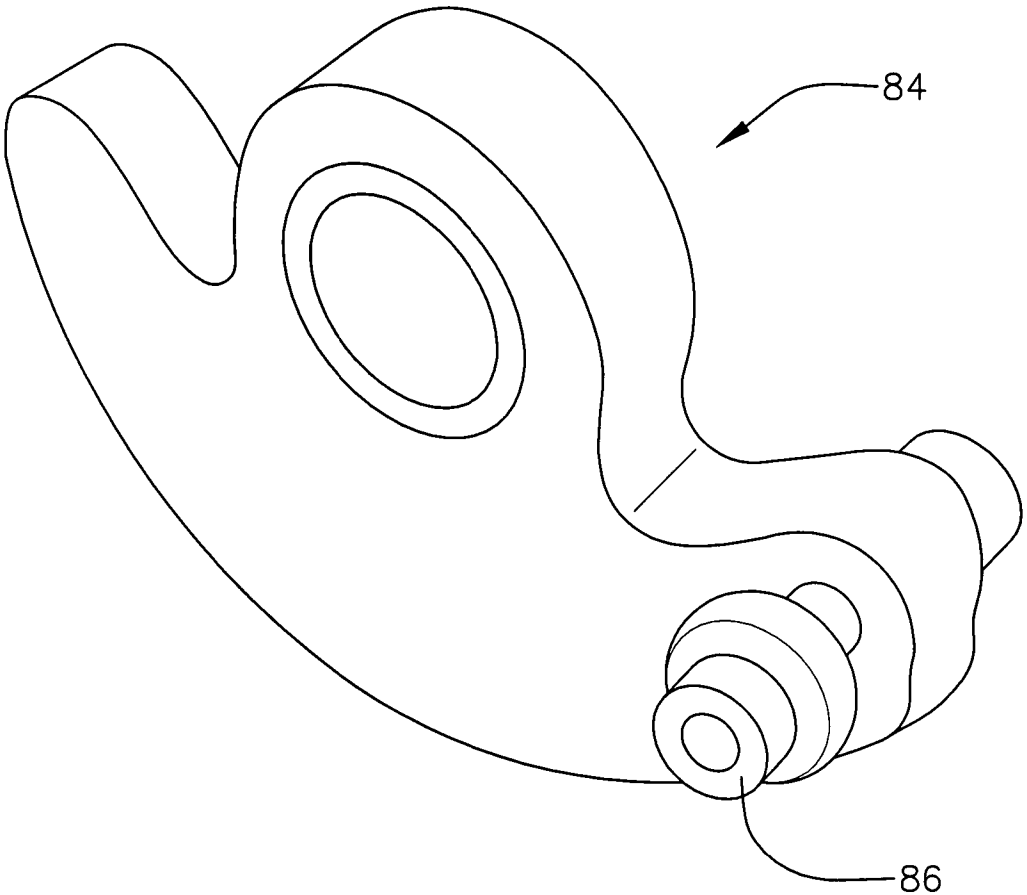
FIG. 19 is a perspective view of the main counterweight of FIG. 18.
Figure 20:
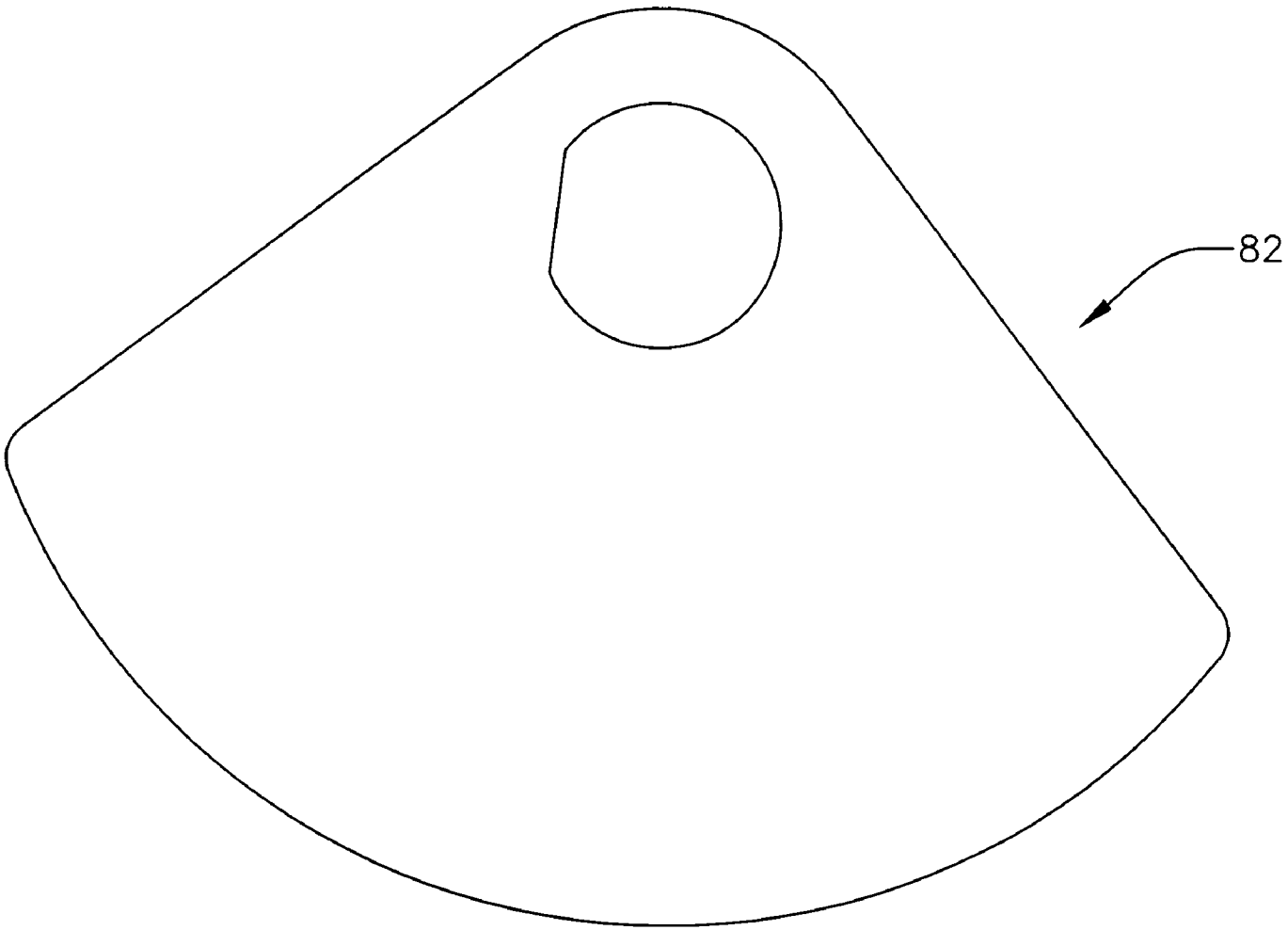
FIG. 20 is a plan view of one of the thin eccentric weights of FIG. 16.
Figure 21:
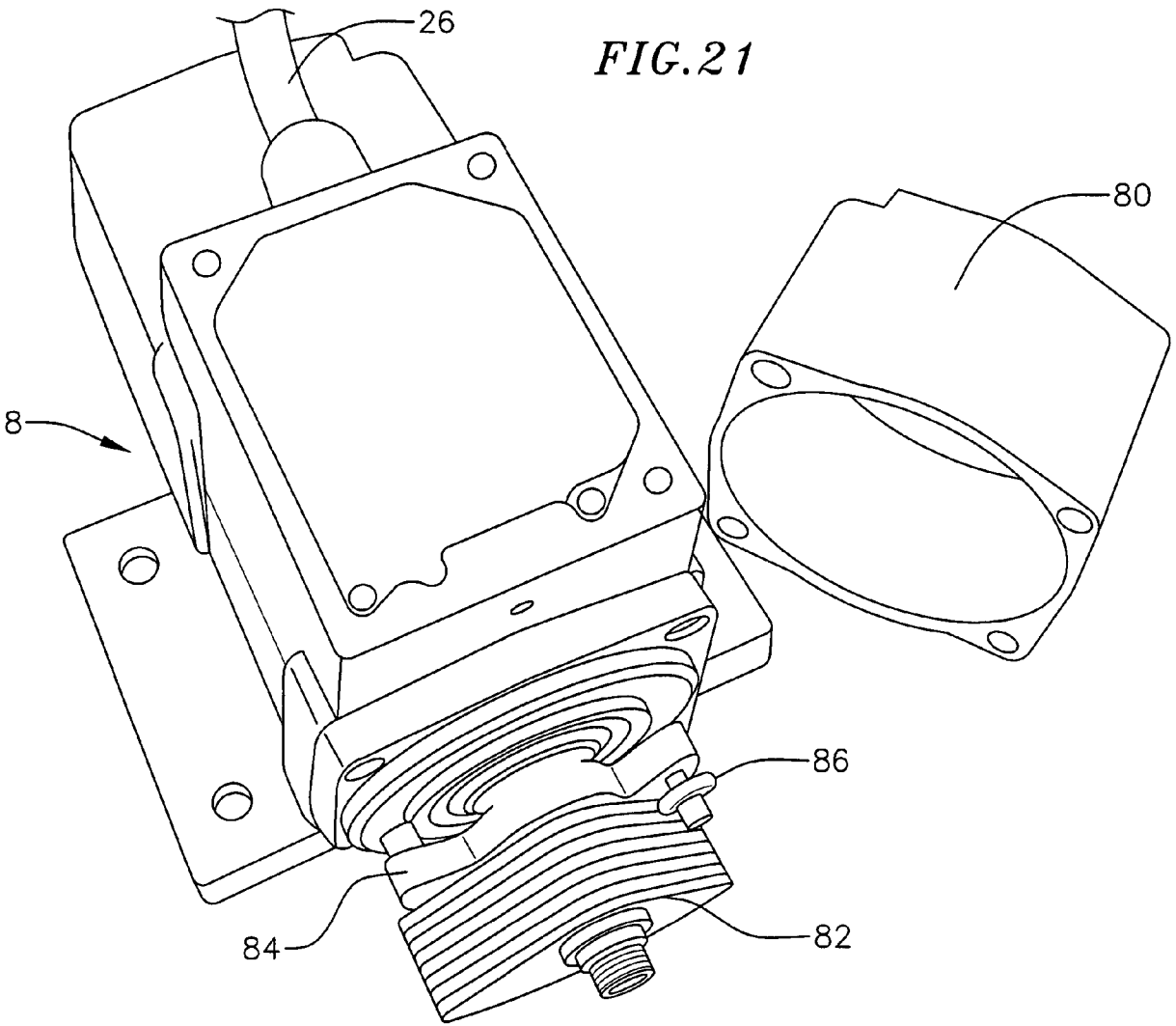
FIG. 21 is a bottom view of a one of the motor assemblies of FIG. 15 with its cover removed to reveal the electrical connections to the motor.

An alternate embodiment of the motor mounting frame 15' is shown in FIG. 12*b*. The motor mounting frame 15' is fixed to a larger steel surface 22', as well as the steel reinforcement 21' and vibration base assembly 19' to increase the stiffness of the frame 15'.

The motor housings 80 and motors 8 are shown in more detail in FIGS. 15-21. Each motor housing 80 encloses an identical motor 8 that rotates a set of eccentric weights 82, 84 at substantially the same frequency and phase as the other motor 8 and in opposite directions. The motors 8 are wired in parallel and, in this embodiment, are bolted to the steel strip 22. In one embodiment, these weights comprise several thin eccentric weights 82 of approximately 60 grams each and one main counterweight 84 weighing approximately 210 grams. The thin eccentric weights 82 rotate with the shaft and have a wide, teardrop shape, with their widths increasing with distance from the axis of rotation. Using a multiplicity of eccentric weights allows the vibration characteristics to be modified, if desired, by adding or subtracting weights.

The counterweight 84 is located between the motor 8 and the thin eccentric weights 82. In one embodiment, the counterweight 84 is shaped similar to a teardrop, with its width increasing with distance from the axis of rotation. It rotates freely around the shaft and includes a rigid projection 86 on one side projecting away from the motor 8 and through the plane of rotation of the thin eccentric weights 82. In the embodiment shown, the thin eccentric weights 82 can rotate around the shaft for almost a full rotation before they collide with the rigid projection 86 and cause the counterweight 84 to rotate with them. This allows more efficient starting operation of the system.

Figure 26:
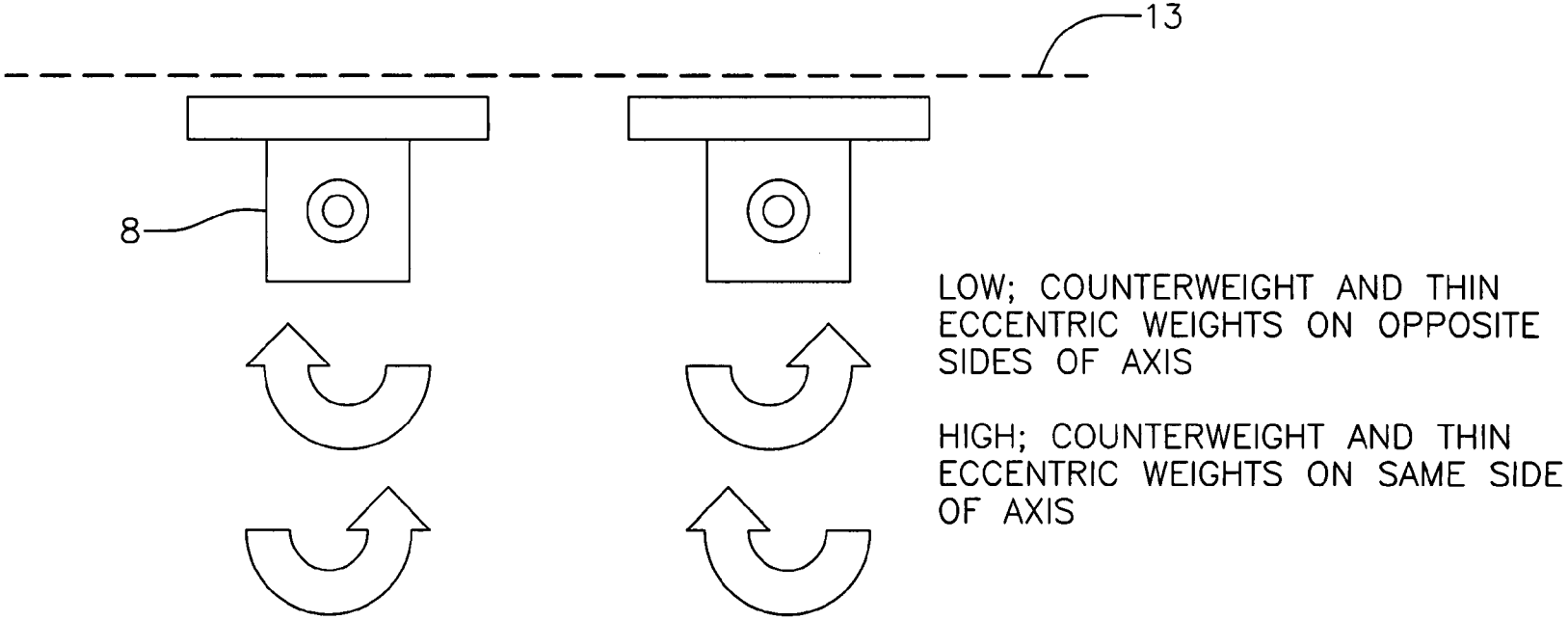
FIG. 26 is a simplified schematic diagram of the motors with the weights removed to show the high and low amplitude rotational directions.
Figure 27:
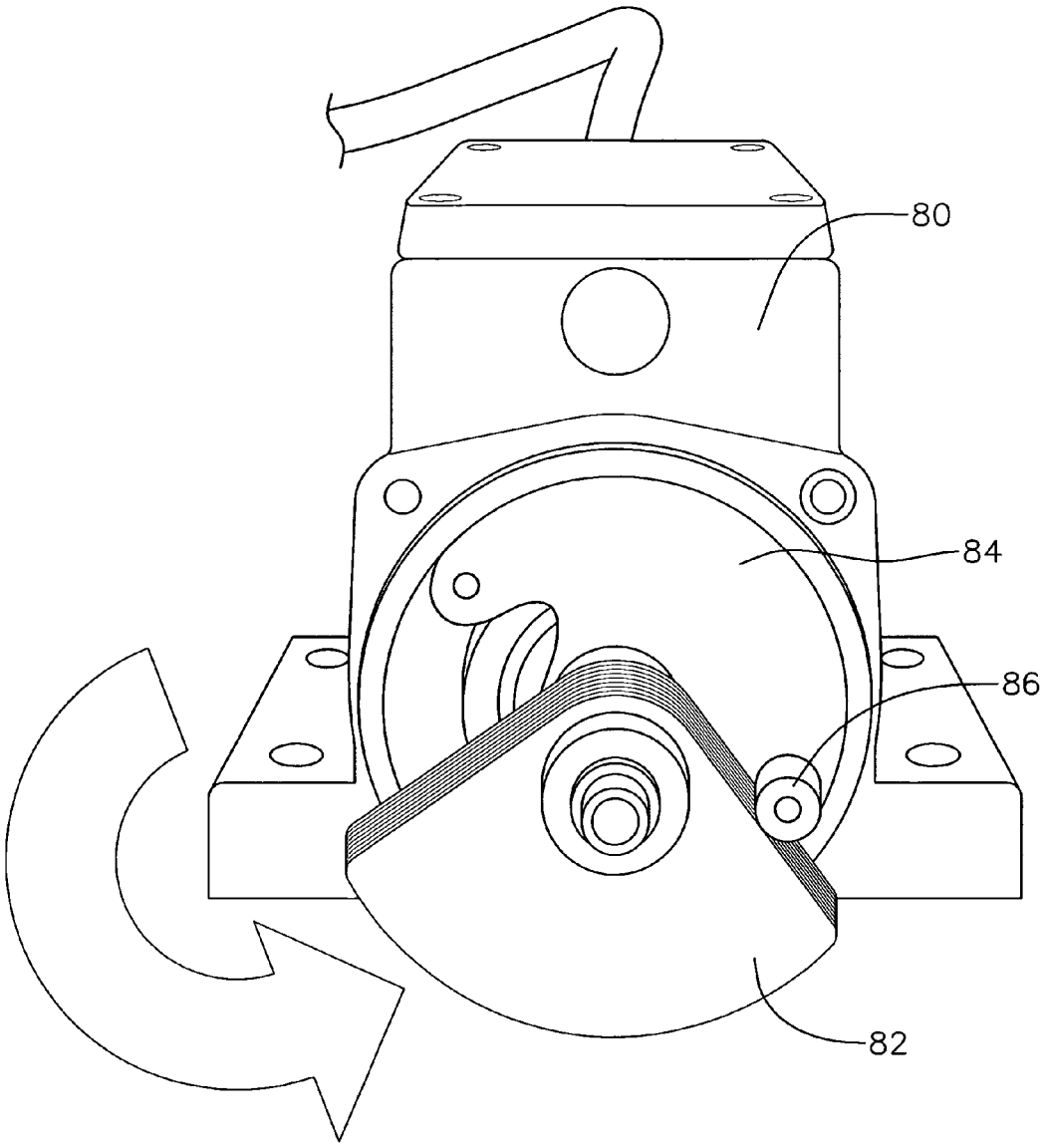
FIG. 27 is a front perspective view of the motor on the right of FIG. 26 with the weights assembled and the arrow of rotation pointing in the low amplitude direction.
Figure 28:
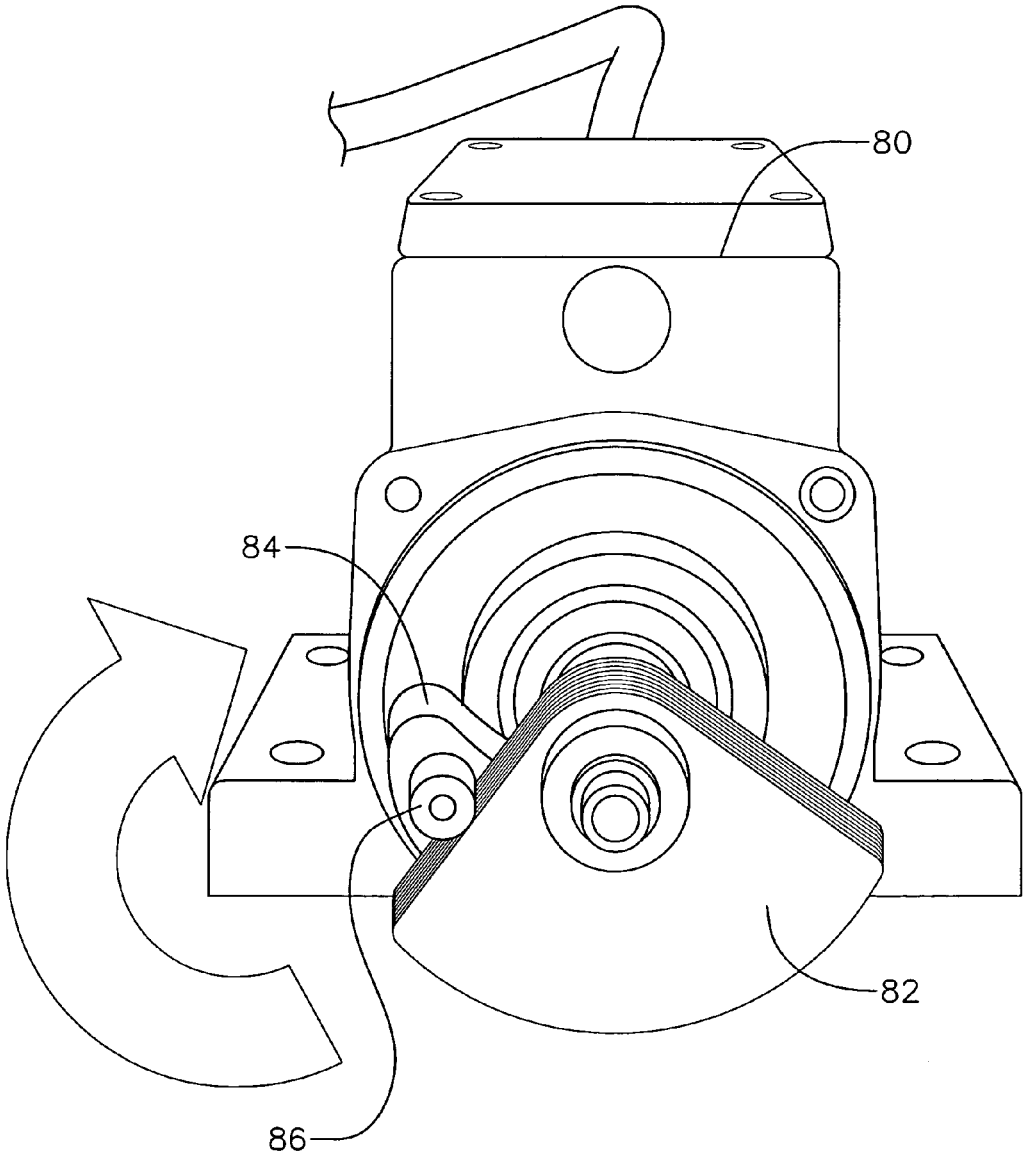
FIG. 28 is a front perspective view of the motor of FIG. 27 with the arrow of rotation pointing in the high amplitude direction.

In one embodiment, the rigid projections 86 on each of the two counterweights 84 extend from opposite sides of their respective counterweights 84, as shown in FIG. 26. With this arrangement, when the motors 8 are rotated in different opposing directions, the thin eccentric weights 82 will collide with different sides of the rigid projections 86, causing the counterweight 84 to either rotate on the same side of the shaft as the eccentric weights 82 or on opposite sides. FIGS. 26 and 27 show the thin eccentric weights 82 of the motor 8 on the right in FIG. 26 rotating in a direction that collides with the rigid projection 86 to force the weights to rotate on opposite sides of the shaft. FIGS. 26 and 28 show the weights when rotating in the opposite direction wherein the thin eccentric weights 82 and the counterweight 84 are rotating on the same side of the shaft. When the weights 82, 84 rotate on the same side of the shaft, a greater vertical force is imparted to the vibrational platform, and the vertical amplitude of the vibration increases. Therefore, the amplitude of vibration can be changed by reversing the opposing rotations of the motors. This can be controlled by an intensity setting on the displays.

In the illustrated embodiment, rotation of the eccentric weights 82, 84 by the two motors 8 in this fashion creates an imbalance in the vibrating platform, causing a vertical sinusoidal movement as well as a slight, erratic, horizontal vibration. As the motors 8 rotate at the same frequency and phase, the frequency of vibration felt by a user standing on the vibrating platform is dependent on the frequency of the AC signal that drives the motors 8. Preferably, the motors 8 are capable of being driven at a wide range of frequencies, and more preferably at frequencies between 25 Hz and 70 Hz. In one embodiment, the motors are also capable of rotating in either direction.

By operating the motors 8 in different opposing directions, a higher intensity vertical vibration, as measured as amplitude, can be achieved. In one embodiment, the amplitude of the vertical vibration increases from 2.5 mm when the motors are rotating in the same direction to 5 mm when the motors are rotating in opposite directions. By varying the frequency and amplitude, various g-forces can be experienced by the user. As described above, the human body naturally resists g-force and vibration, and the muscles used in resisting are strengthened. In one embodiment, the g-forces felt at low amplitude settings (approximately 2.5 mm) are 2.28 g and 2.71 g at 35 Hz and 40 Hz, respectively, and at high amplitude settings (approximately 5 mm) are 3.91 g and 5.09 g at 35 Hz and 40 Hz, respectively.

FIGS. 2-3, 8, 22-23 and 25 show the main console 3 and its connections in more detail. The main console 3 includes a main display 2, a bottom or secondary display 4, a power inlet and switch assembly 9 and an electronics console 11. Preferably, the main console 3 includes handlebars 1 that reach a height convenient for a user to grasp them with his or her hands. At the main display 2, a user may receive instructions regarding possible input values and can input the time of exercise, the frequency of vibration, a high or low intensity level, and whether the exercise at those setting should be repeated. This information is sent to the secondary display 4.

Figure 22:
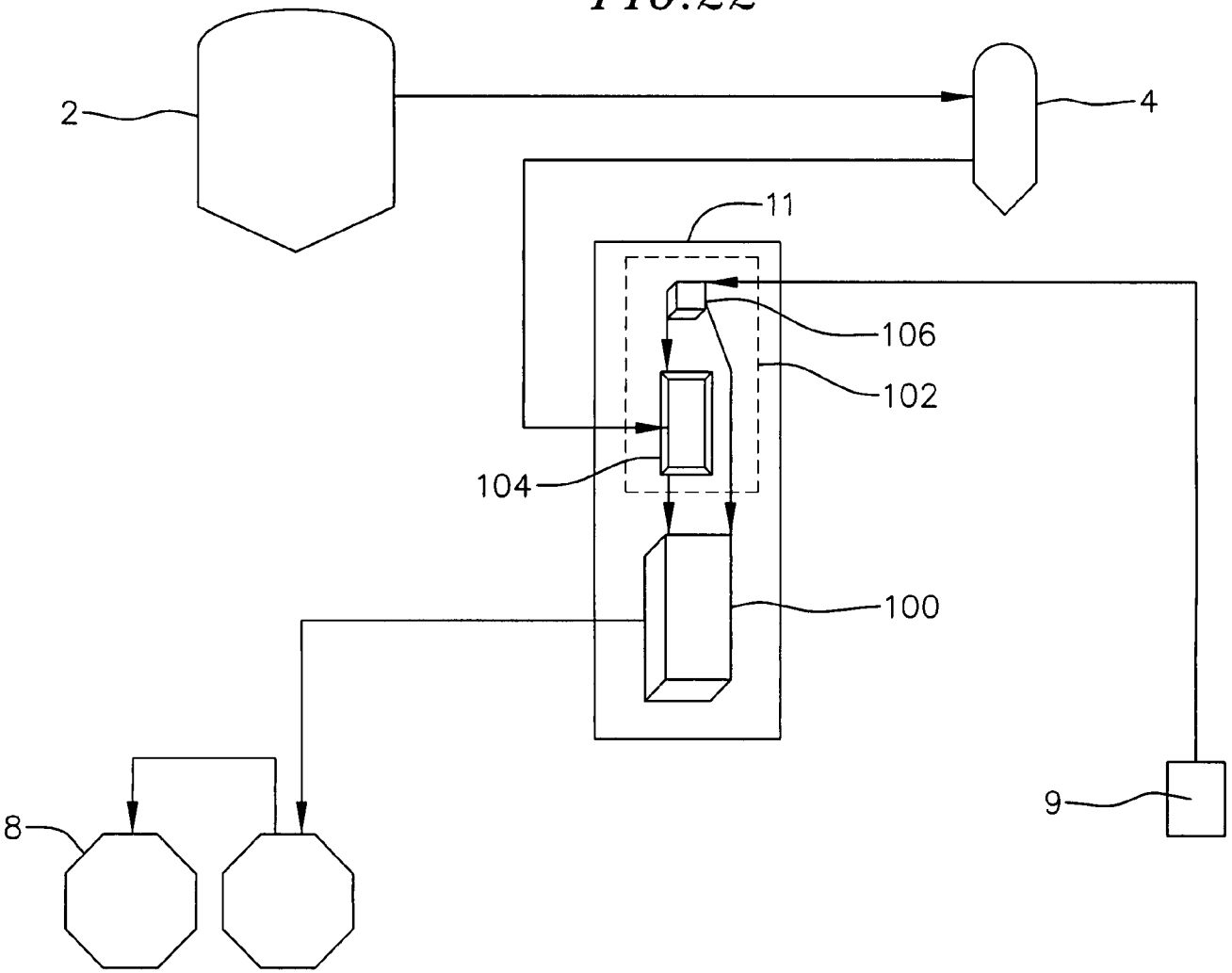
FIG. 22 is a block diagram of the vibrational fitness apparatus embodiments of FIGS. 1 and 8.
Figure 23:
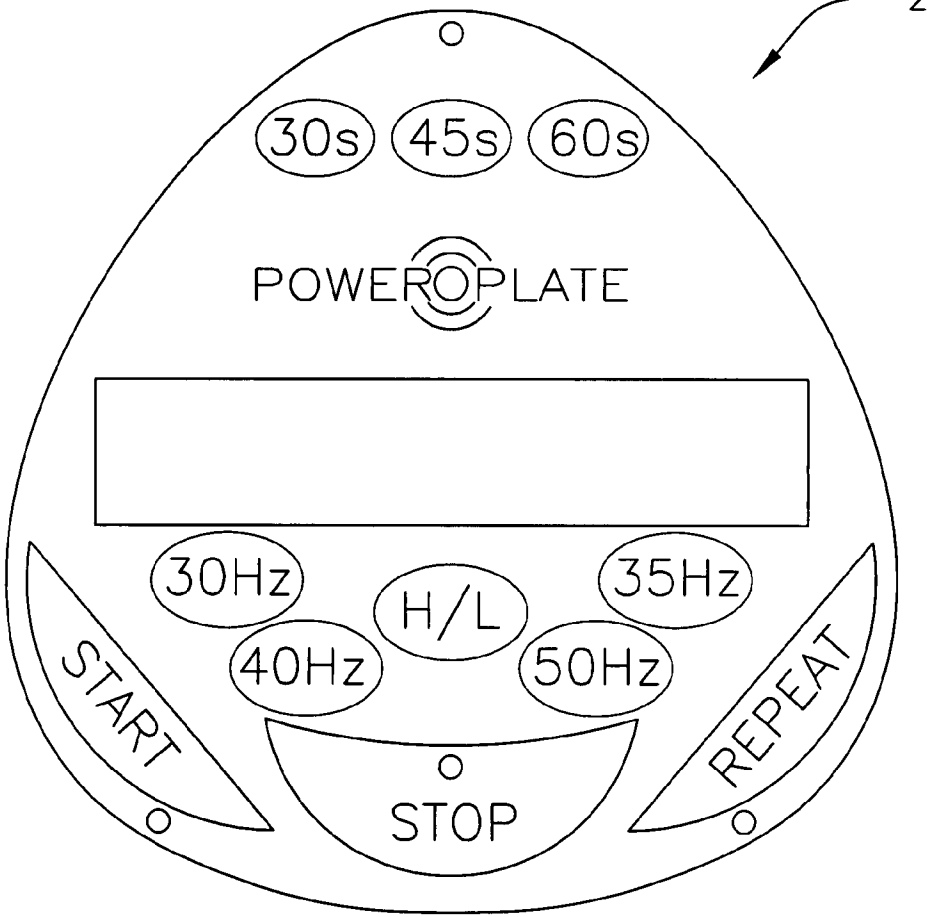
FIG. 23 is a plan view of a main display of the embodiments shown in FIGS. 1 and 8.
Figure 24:
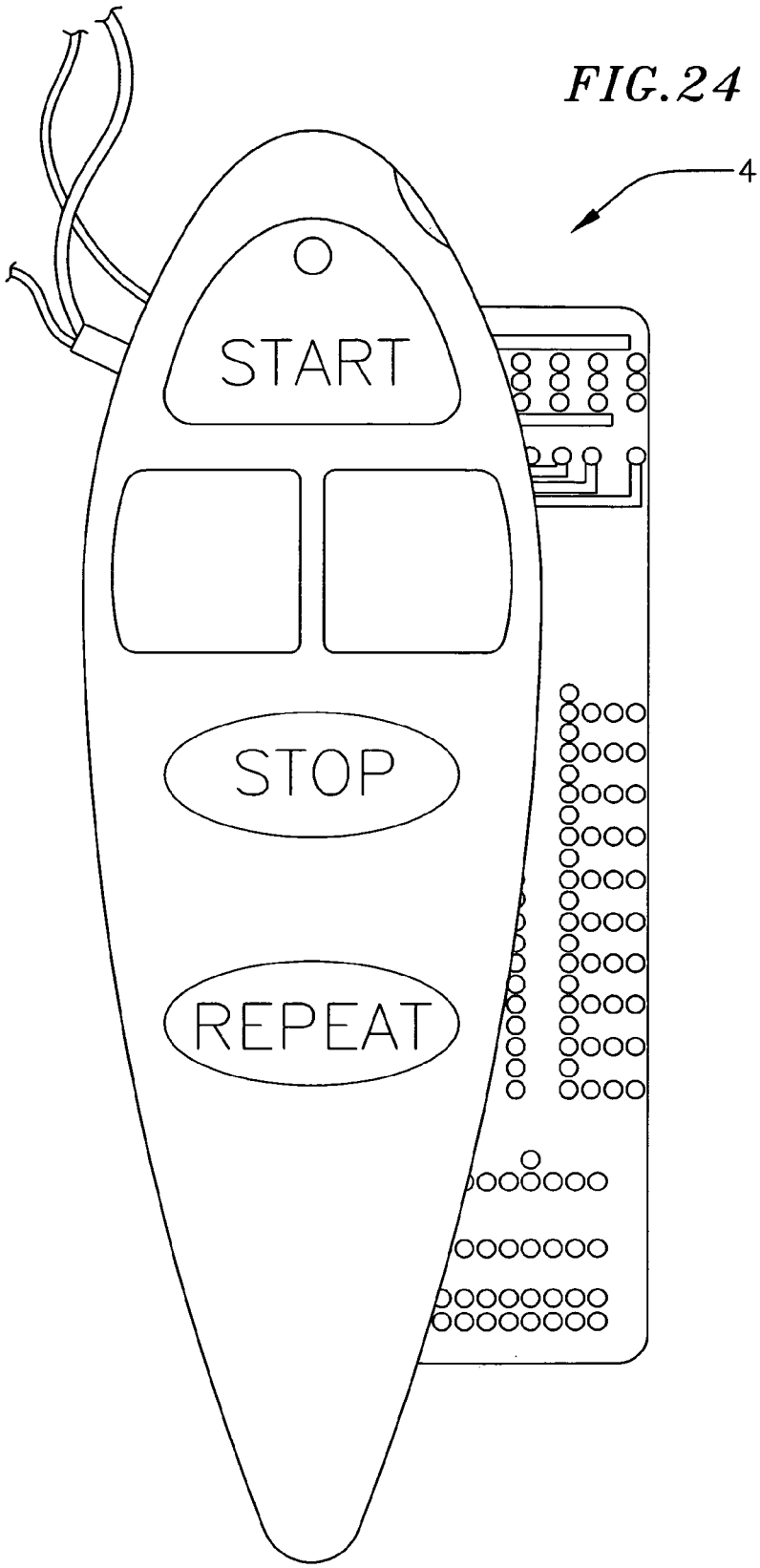
FIG. 24 is a plan view of a secondary display of the embodiments shown in FIGS. 1 and 8.
Figure 25:
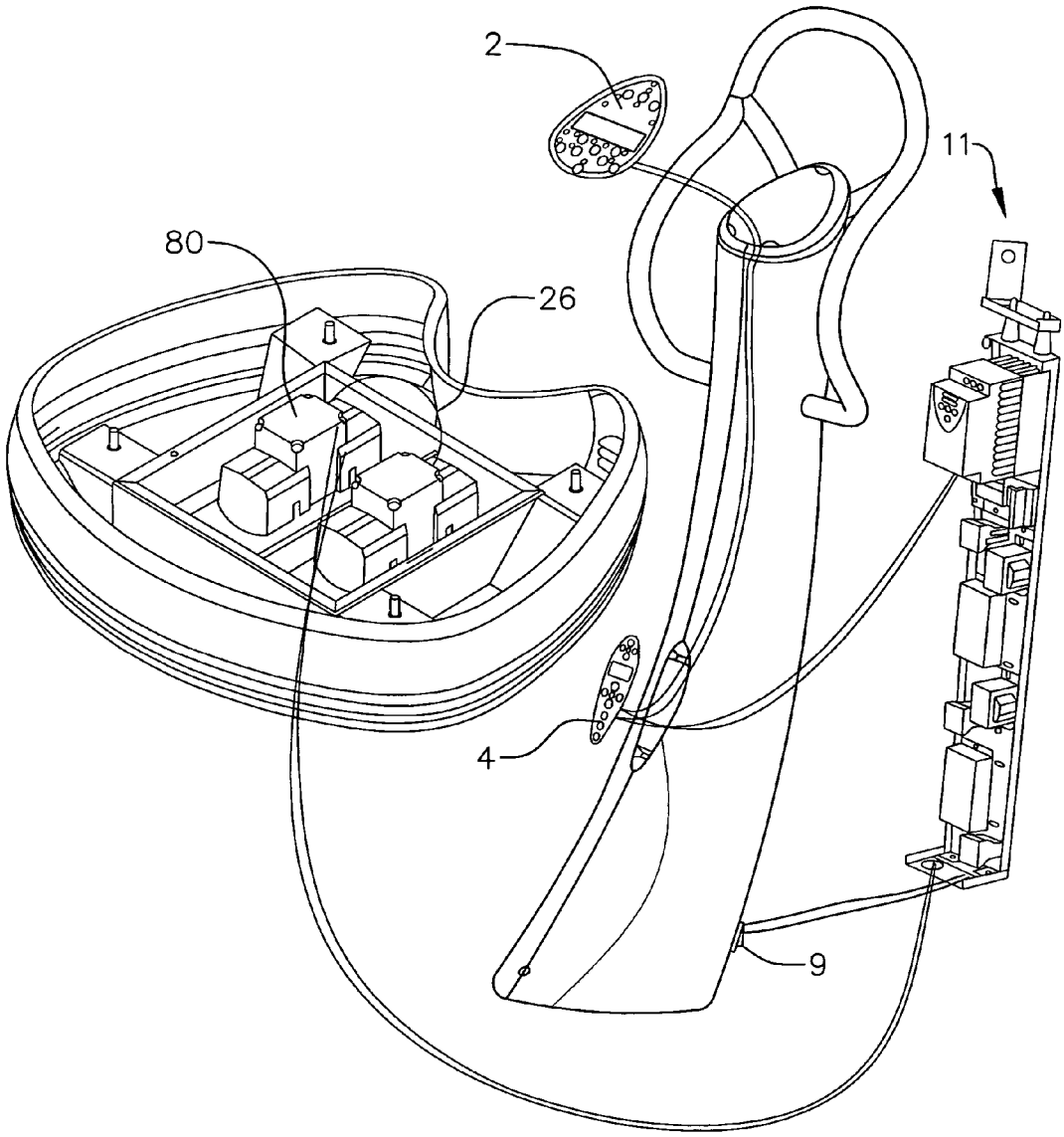
FIG. 25 is a partially exploded view of the main display, secondary display and electronics console of FIGS. 1 and 8.

In reference to FIGS. 22 and 24-25 the secondary display 4 shows on a digital LED a countdown timer showing the remaining operating time, based on the value input into the main display 2 by the user. The panel also has "start," "stop," and "repeat" buttons to operate and restart the apparatus using the last values input by the user. In one embodiment, this secondary display 4 is mounted in a lower section of the main console 3 to allow users doing exercises that are low to the floor, such as push-ups, to operate the apparatus at a convenient height. The information input into the secondary 4 and main 2 displays is sent to the electronics console 11 via a multi core flat cable.

FIGS. 2 and 22 show the electronics console 11 in more detail. The electronics console 11 includes an AC motor drive 100 and a controller 102. The controller 102 receives signals from the main 2 and secondary 4 displays and communicates these settings to the motor drive 100. In one embodiment, the electronics console 11 includes a programmable chip 104 and a power regulator 106.

The motor drive 100 receives AC power from a 110V or 220V power outlet, through the power inlet/switch assembly 9 and power regulator 106. The motor drive 100 then outputs power to the motors 8 at a range of specified frequencies, based on the signals from the controller 102. In one embodiment, the motor drive 100 outputs power at 30 Hz, 35 Hz, 40 Hz or 50 Hz, in response to signals from the controller 102. In one embodiment, the motor drive 100 is constructed to drive the motors 8 to rotate in opposite directions in response to the user inputting a high intensity setting from the main display 4. In one embodiment, the motor drive 100 is a Delta VFD-M (220V) or -S(110V) model. In another embodiment, the motor drive 100 is a Telemecanique Altivar model.

Although the foregoing describes the invention in terms of embodiments, the embodiments are not intended to cover all modifications and alternative constructions falling within the spirit and scope of the invention, and are limited only by the plain meaning of the words as used in the eventual claims.

What is claimed is:

1. A body vibration apparatus comprising:

an at least partially rigid platform;

a first motor coupled to the platform such that movement of the first motor imparts force to the platform, the first motor having a first shaft that selectively rotates in one of a first direction and a second direction;

a first eccentric weight coupled to the first shaft such that the first eccentric weight rotates with the first shaft at a first phase and in a first plane;

a second motor coupled to the platform such that movement of the second motor imparts force to the platform, the second motor having a second shaft parallel to the first shaft that selectively rotates in the other of the first direction and the second direction;

a second eccentric weight coupled to the second shaft in the first plane such that the second eccentric weight rotates with the second shaft at the first phase;

a third eccentric weight proximate the first eccentric weight, the third eccentric weight coupled for rotation about the first shaft only between a first angular orientation with respect to the first eccentric weight and a second angular orientation with respect to the first eccentric weight, the second angular orientation with respect to the first eccentric weight being different from the first angular orientation with respect to the first eccentric weight; and a forth eccentric weight proximate the second eccentric weight, the forth eccentric weight coupled for rotation about the second shaft only between a first angular orientation with respect to the second eccentric weight and a second angular orientation with respect to the second eccentric weight, the second angular orientation with respect to the second eccentric weight being different from the first angular orientation with respect to the second eccentric weight.

2. The apparatus of claim 1, further comprising:

a motor drive providing power to the first motor and second motor; and a controller controlling the power provided by the motor drive to the first motor and the second motor.

3. The apparatus of claim 2, further comprising a first interface coupled to the controller for selecting a desired characteristic of motor operation.

4. The apparatus of claim 3, where in the desired characteristic of motor operation is a frequency of motor rotation.

5. The apparatus of claim 3, wherein the desired characteristic of motor rotation is an on or off power status of the first motor and the second motor.

6. The apparatus of claim 3, wherein the desired characteristic of motor rotation is a duration over which power is supplied to the first motor and the second motor.

7. The apparatus of claim 3, wherein the desired characteristic of motor rotation is a direction of rotation of the first motor, the second motor, or both.

8. The apparatus of claim 3, further comprising a second interface coupled to the controller for selecting the desired power setting.

9. The apparatus of claim 8, wherein the second interface is located closer to the platform than is the first interface.

10. The apparatus of claim 1, further comprising a console coupled to the platform and projecting upward therefrom.

11. The apparatus of claim 10, further comprising a handlebar connected to the console.

12. The apparatus of claim 1, further comprising:

a first motor mounting frame coupled to and at least partially supporting the first motor, the second motor, and the platform; and at least one vibration mount coupled to and at least partially supporting the first motor mounting frame.

13. The apparatus of claim 12, wherein the at least one vibration mount is at least partially resilient.

14. The apparatus of claim 13, wherein the at least one vibration mount damps movement of the motor mounting frame more in a direction transverse to the first shaft than in a vertical direction.

15. The apparatus of claim 12, wherein the at least one vibration mount is hollow.

16. The apparatus of claim 12, wherein the at least one vibration mount has a substantially hexagonal cross-section.

17. The apparatus of claim 12, further comprising a metal baseplate supporting the at least one vibration mount.

18. The apparatus of claim 1, wherein the first eccentric weight includes a first rigid projection on a first side projecting toward the third eccentric weight, wherein the second eccentric weight includes a second rigid projection on a second side opposite the first side projecting toward the fourth eccentric weight, and wherein the first rigid projection and the second rigid projection are located such that when the first eccentric weight and the second eccentric weight are rotated in the respective first and second directions, respective edges of the first eccentric weight and the second eccentric weight engage the first and second rigid projections of the respective third eccentric weight and fourth eccentric weight to rotate them.

19. The apparatus of claim 1, wherein when the first eccentric weight is rotated in the first direction, the first eccentric weight rotates in a first relationship with respect to the third eccentric weight, and wherein when the first eccentric weight is rotated in the second direction, the first eccentric weight rotates in a second relationship with respect to the third eccentric weight.

20. The apparatus of claim 19, wherein when the second eccentric weight is rotated in the second direction, the second eccentric weight rotates in a first relationship with respect to the fourth eccentric weight, and wherein when the second eccentric weight is rotated in the first direction, the second eccentric weight rotates in a second relationship with respect to the fourth eccentric weight.

21. The apparatus of claim 1, wherein the first direction is opposite to the second direction.

* * * * *